US011598044B2

(12) United States Patent
Lee et al.

(10) Patent No.: US 11,598,044 B2
(45) Date of Patent: Mar. 7, 2023

(54) LAUNDRY PROCESSING APPARATUS

(71) Applicant: LG Electronics Inc., Seoul (KR)

(72) Inventors: Man Seok Lee, Seoul (KR); Myoung Jong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 16/992,665

(22) Filed: Aug. 13, 2020

(65) Prior Publication Data

US 2021/0047775 A1 Feb. 18, 2021

(30) Foreign Application Priority Data

Aug. 14, 2019 (KR) ..... 10-2019-0099647

(51) Int. Cl.

| | |
|---|---|
| ***D06F 58/24*** | (2006.01) |
| ***D06F 25/00*** | (2006.01) |
| ***D06F 39/08*** | (2006.01) |
| ***D06F 58/04*** | (2006.01) |
| ***D06F 58/20*** | (2006.01) |

(52) U.S. Cl.

CPC ..... *D06F 58/24* (2013.01); *D06F 25/00* (2013.01); *D06F 39/085* (2013.01); *D06F 58/04* (2013.01); *D06F 58/206* (2013.01)

(58) Field of Classification Search

CPC ..... D06F 58/24; D06F 58/04; D06F 58/206; D06F 25/00; D06F 39/085

USPC ..... 34/72, 595–610

See application file for complete search history.

(56) References Cited

U.S. PATENT DOCUMENTS 2,334,025 A * 11/1943 O'Neill ..... D06F 58/24 38/143
2,676,418 A * 4/1954 Shewmon ..... F26B 21/086 34/91
2,680,916 A * 6/1954 Smith ..... D06F 58/24 137/516.11

(Continued)

FOREIGN PATENT DOCUMENTS

| | | |
|---|---|---|
| DE | 9415035 | 2/1996 |
| EP | 2141279 | 1/2010 |

(Continued)

OTHER PUBLICATIONS

Extended European Search Report in European Application No. 20189674.3, dated Nov. 9, 2020, 10 pages.

(Continued)

*Primary Examiner* — Stephen M Gravini
(74) *Attorney, Agent, or Firm* — Fish & Richardson P.C.

(57) ABSTRACT

A laundry processing apparatus includes a wall defining a condensed water collecting space configured to collect condensed water. The wall has an opening hole that is open to communicate with an inside of a cabinet of the laundry processing apparatus and that is configured to open and close by an opening and closing unit. Therefore, when the laundry processing apparatus is not operated, the condensed water remaining in the condensed water collecting space is quickly removed by air inside the cabinet, and during drying operation or drainage operation, the opening hole is closed by the opening and closing unit, pressure leakage is prevented for a space where air flows or a space where the condensed water is pumped.

20 Claims, 22 Drawing Sheets

(56) References Cited

U.S. PATENT DOCUMENTS

| | | | | | |
|---|---|---|---|---|---|
| 2,686,372 | A * | 8/1954 | Graham | D06F 58/04 | 239/524 |
| 2,722,057 | A * | 11/1955 | Pugh | D06F 58/20 | 34/79 |
| 3,006,176 | A * | 10/1961 | Behrens | D06F 58/22 | 68/19.2 |
| 4,112,590 | A * | 9/1978 | Muller | D06F 58/24 | 34/77 |
| 5,887,456 | A * | 3/1999 | Tanigawa | D06F 39/083 | 68/18 C |
| 6,293,121 | B1 * | 9/2001 | Labrador | F03D 5/00 | 62/304 |
| 2005/0066538 | A1 * | 3/2005 | Goldberg | D06F 34/26 | 34/218 |
| 2005/0120715 | A1 * | 6/2005 | Labrador | F03G 7/00 | 60/618 |
| 2011/0023318 | A1 * | 2/2011 | Jung | D06F 58/06 | 34/108 |
| 2021/0047775 | A1 * | 2/2021 | Lee | D06F 58/24 | |

FOREIGN PATENT DOCUMENTS

| | | | | |
|---|---|---|---|---|
| EP | 2163677 | | 3/2010 | |
| EP | 2163677 | | 3/2017 | |
| EP | 3779028 | A1 * | 2/2021 | D06F 25/00 |
| GB | 792758 | A * | 4/1958 | |
| KR | 20140106910 | A * | 1/2006 | |
| KR | 1020100090087 | | 8/2010 | |
| KR | 1020160087183 | | 7/2016 | |
| KR | 1020160149852 | | 12/2016 | |
| KR | 101919887 | | 11/2018 | |
| WO | WO2011157560 | | 12/2011 | |

OTHER PUBLICATIONS

Office Action in European Appln. No. 20189674.3, dated Sep. 23, 2022, 5 pages.

* cited by examiner

LAUNDRY PROCESSING APPARATUS

CROSS-REFERENCE TO RELATED APPLICATION

The present application claims priority to Korean Patent Application No. 10-2019-0099647, filed on Aug. 14, 2019, the entire contents of which are incorporated herein for all purposes by reference.

TECHNICAL FIELD

The present disclosure relates generally to a structure of removing residual water of a laundry processing apparatus having a drying function for clothing or bed linen.

BACKGROUND

Generally, a laundry processing apparatus includes a washing machine, a drying machine for clothing, a washing machine having both drying and washing functions, and the like, and performs functions for overall processing, such as washing, drying, and removing wrinkles of clothing, for clothing or various bed linen at home or at laundromat.

The clothing drying machine of the laundry processing apparatus includes a heat pump system. The clothing drying machine is configured to supply high temperature air to an object to be processed such as clothing and bed linen (hereinafter, the above-mentioned object will be referred to as clothing to be processed) which are inserted into a drum (or tub), through the operation of the heat pump system. Thus, moisture contained in the clothing to be processed is evaporated so that the clothing to be processed is dried.

The clothing drying machine may be classified into an exhaust type drying machine and a condensation type drying machine that are classified according to the processing method of high temperature and humid air escaping from the drum after drying the clothing to be processed.

The exhaust type drying machine is configured to discharge the high temperature and humid air generated during drying operation directly to the outside of the drying machine. The condensation type drying machine is configured to condense moisture contained in the air through the heat exchange while circulating the high temperature and humid air without discharging the high temperature and humid air to the outside.

In particular, in cased of the condensation type drying machine, the drying machine is configured to have the heat pump system including a compressor, an expansion valve, a condenser, and an evaporator, and is configured such that, air loses moisture while passing through the evaporator of the heat pump system and then is heated while passing through the condenser.

In relation to above description, it is as proposed in Korean Patent Application Publication No. 10-2010-0090087, Korean Patent Application Publication No. 10-2013-0127816, Korean Patent Application Publication No. 10-2016-0087183, and Korean Patent Application Publication No. 10-2016-0149852.

Meanwhile, the condensation type drying machine according to the above-described related arts is configured such that, air heat-exchanges while passing through the evaporator to generate much condensed water. The condensed water flows down to the bottom in a circulation flow path and then flows into and is stored in a portion (condensed water collecting part) where a water pump is positioned.

However, the portion where the condensed water flows is formed in a space that is shielded from the outside environment in order to easily pump the condensed water. Therefore, when residual water remains in the space, the residual water is not quickly evaporated and continues to remain, thereby causing a problem of contamination and odor from the residual water.

In order to fundamentally solve the above problem, it is preferable that residual water does not remain.

However, in order to allow the condensed water falling down to the bottom of the circulation flow path to flow smoothly into the portion where the water pump is positioned, inclination of the bottom should be adjusted, and the inclination of the bottom may not formed as steep inclination, considering that it is difficult to maintain horizontality of other components (for example, evaporator, condenser, etc.) when the components are installed.

In addition, since various structures (for example, water cover, etc. on which evaporator or condenser is seated) are provided on the bottom of the circulation flow path and various contact portions are provided thereon, it is difficult to eliminate a problem in which the condensed water remains in the contact portions.

Further, it is preferable that the condensed water stored in the portion where the water pump is positioned is completely discharged by using the water pump, but it is actually difficult to realize change of design for complete discharge of the condensed water due to structural limitation of the water pump.

DOCUMENTS OF RELATED ART (Patent Document 1) Korean Patent Application Publication No. 10-2010-0090087;

(Patent Document 2) Korean Patent Application Publication No. 10-2016-0087183;

(Patent Document 3) Korean Patent Application Publication No. 10-2016-0149852; and (Patent Document 4) Korean Patent Application Publication No. 10-2013-0127816 (Korean Patent No. 10-1919887).

SUMMARY

Accordingly, the present disclosure has been made keeping in mind the above problems occurring in the related art, and the present disclosure is intended to propose a laundry processing apparatus according to a new form configured to quickly remove condensed water remaining on the bottom of a circulation flow path or a condensed water collecting part.

Another objective of the present disclosure is to provide a laundry processing apparatus according to a new form configured to remove the condensed water remaining on the bottom of the circulation flow path or the condensed water collecting part by outside air.

A further objective of the present disclosure is to provide a laundry processing apparatus according to a new form configured to remove the condensed water remaining on the bottom of the circulation flow path or the condensed water collecting part by outside air with preventing poor air circulation due to pressure leakage in the spaces or poor pumping performance during a drying operation.

A further objective of the present disclosure is to provide a laundry processing apparatus according to a new form configured to allow outside air to smoothly flow into the bottom of the circulation flow path or the inside of the condensed water collecting part when the drying operation or drainage operation is not performed.

In order to achieve the above objectives, according to one aspect of the present disclosure, there is provided a laundry processing apparatus. The laundry processing apparatus of the present disclosure is configured such that, a condensed water collecting space, in which condensed water exists and the space being partitioned from the inside of a cabinet of the apparatus, is opened to the inside of the cabinet, so that the condensed water remaining in the condensed water collecting space may be quickly removed by outside air.

The laundry processing apparatus of the present disclosure is configured such that, an opening hole is closed during drying operation or drainage operation, so that pressure loss may be prevented during each operation.

The laundry processing apparatus of the present disclosure is configured such that, an opening and closing unit is provided for selectively opening and closing the opening hole and the opening and closing unit is operated by a non-electronic method, so that the opening and closing unit may be operated accurately at the correct timing without the need for separate control.

The laundry processing apparatus of the present disclosure is configured such that, the opening and closing unit is operated by using the pressure in the condensed water collecting space, so that the opening and closing unit may be operated accurately at the correct timing without the need for separate control.

The laundry processing apparatus of the present disclosure is configured such that, the opening and closing unit is operated by the non-electronic method in which the opening and closing unit opens the opening hole while being operated by its own weight when the pressure in the condensed water collecting space is removed, so that the opening and closing unit may be operated accurately at the correct timing without the need for separate control.

The laundry processing apparatus of the present disclosure is configured such that, the opening hole and the opening and closing unit selectively open the inside space of a circulation flow path, so that the condensed water remaining in the bottom of the circulation flow path may be quickly removed.

The laundry processing apparatus of the present disclosure is configured such that, the opening hole and the opening and closing unit selectively open the inside space of a condensed water collecting part, so that the condensed water remaining in the condensed water collecting part may be quickly removed.

The laundry processing apparatus of the present disclosure is configured such that, the opening and closing unit is provided at different positions from each other in response to the pressure in the condensed water collecting space to open the opening hole, so that the opening and closing unit may be operated accurately at the correct timing.

The laundry processing apparatus of the present disclosure is configured such that, the opening and closing unit includes a contact plate covering the opening hole, so that the airtightness may be maintained during the drying operation or the drainage operation.

The laundry processing apparatus of the present disclosure is configured such that, the opening and closing unit includes the contact plate and a penetrating installation part protruding from the contact plate, so that the structure of the opening and closing unit may be simplified.

The laundry processing apparatus of the present disclosure is configured such that, the penetrating installation part of the opening and closing unit is loosely installed in an installation slot, so that the contact plate may maintain airtightness even at a small pressure (air suction force) and may smoothly open the opening hole when the pressure is removed from the contact plate.

The laundry processing apparatus of the present disclosure is configured such that, the contact plate is configured to be tilted vertically, so that the contact plate may be operated precisely.

The laundry processing apparatus of the present disclosure is configured such that, an upper end portion of the contact plate is heavier than a lower end portion thereof, so that the contact plate may be operated precisely.

The laundry processing apparatus of the present disclosure is configured such that, the upper end portion of the contact plate is thicker than the lower end portion thereof, so that the contact plate may be operated precisely.

The laundry processing apparatus of the present disclosure is configured such that, the opening hole and the opening and closing unit are provided at multiple places, so that drying effect on the inside of the condensed water collecting space may be improved.

The laundry processing apparatus of the present disclosure is configured such that, the opening hole and the opening and closing unit are provided at a portion of either side wall defining a circulation flow path, the portion being a portion where an evaporator is positioned, so that the condensed water may be smoothly removed from the evaporator.

The laundry processing apparatus of the present disclosure is configured such that, the opening hole and the opening and closing unit are provided on an upper surface of a drainage pump assembly, so that the condensed water remaining in the condensed water collecting part may be removed completely.

The laundry processing apparatus of the present disclosure is configured such that, the opening and closing unit having a closed tube is provided, so that the opening and closing unit may be provided at a narrow space such as the drainage pump assembly.

As described above, the laundry processing apparatus of the present disclosure is configured such that, the condensed water collecting space that stores the condensed water and is partitioned from the inside space of the cabinet may be opened to the inside space of the cabinet. Accordingly, the condensed water remaining in the condensed water collecting space can be quickly removed by outside air.

Further, the laundry processing apparatus of the present disclosure is configured such that, the opening hole is closed during the drying operation or the drainage operation. Accordingly, pressure loss during each operation can be prevented.

Further, the laundry processing apparatus of the present disclosure is configured as a non-electronic structure in which the opening and closing unit provided to selectively open and close the opening hole is operated by using the pressure in the condensed water collecting space. Accordingly, the opening and closing unit can be accurately operated at the correct timing without the need for separate control.

Further, the laundry processing apparatus of the present disclosure is configured such that, the opening hole and the opening and closing unit selectively open the inside space of the circulation flow path. Accordingly, the condensed water remaining in the bottom of the circulation flow path can be quickly removed.

Further, the laundry processing apparatus of the present disclosure is configured such that, the opening hole and the opening and closing unit selectively open the inside space of the condensed water collecting part. Accordingly, the condensed water remaining in the condensed water collecting part can be quickly removed.

Further, the laundry processing apparatus of the present disclosure is configured as the non-electronic structure in which the opening and closing unit constituting the laundry processing apparatus opens the opening hole while being operated by its own weight when the pressure in the condensed water collecting space is eliminated. Accordingly, the opening and closing unit can be accurately operated at the correct timing without the need for separate control.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinbelow, exemplary embodiment of a laundry processing apparatus and a method for controlling operation thereof according to the present disclosure will be described with reference to accompanying FIGS. 1 to 23.

Prior to the description, it is assumed that the laundry processing apparatus of the present disclosure is a clothing drying machine that dries laundry by providing dry and hot air.

Figure 1:
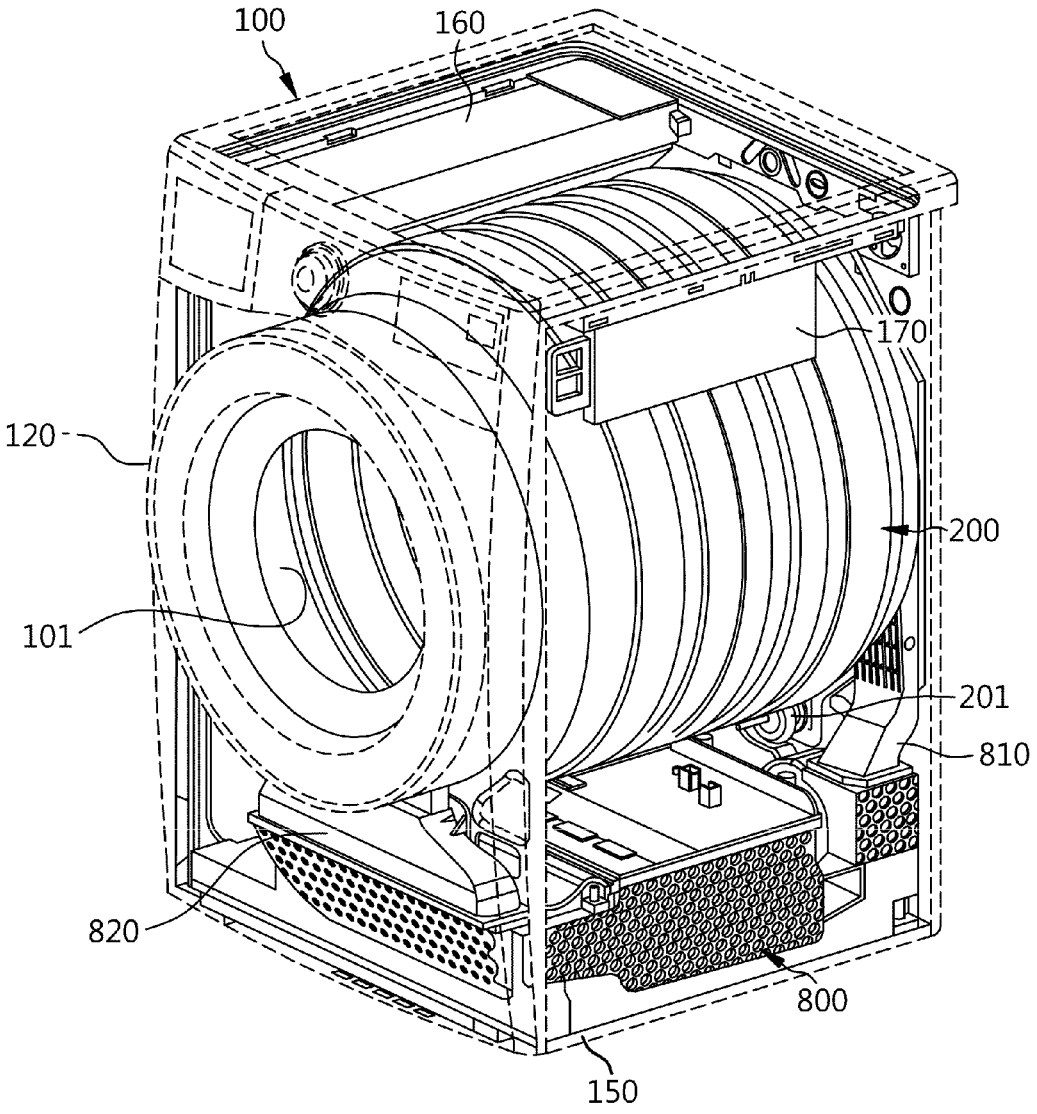
FIG. 1 is a perspective view showing an interior structure of a laundry processing apparatus according to an embodiment of the present disclosure.
Figure 2:
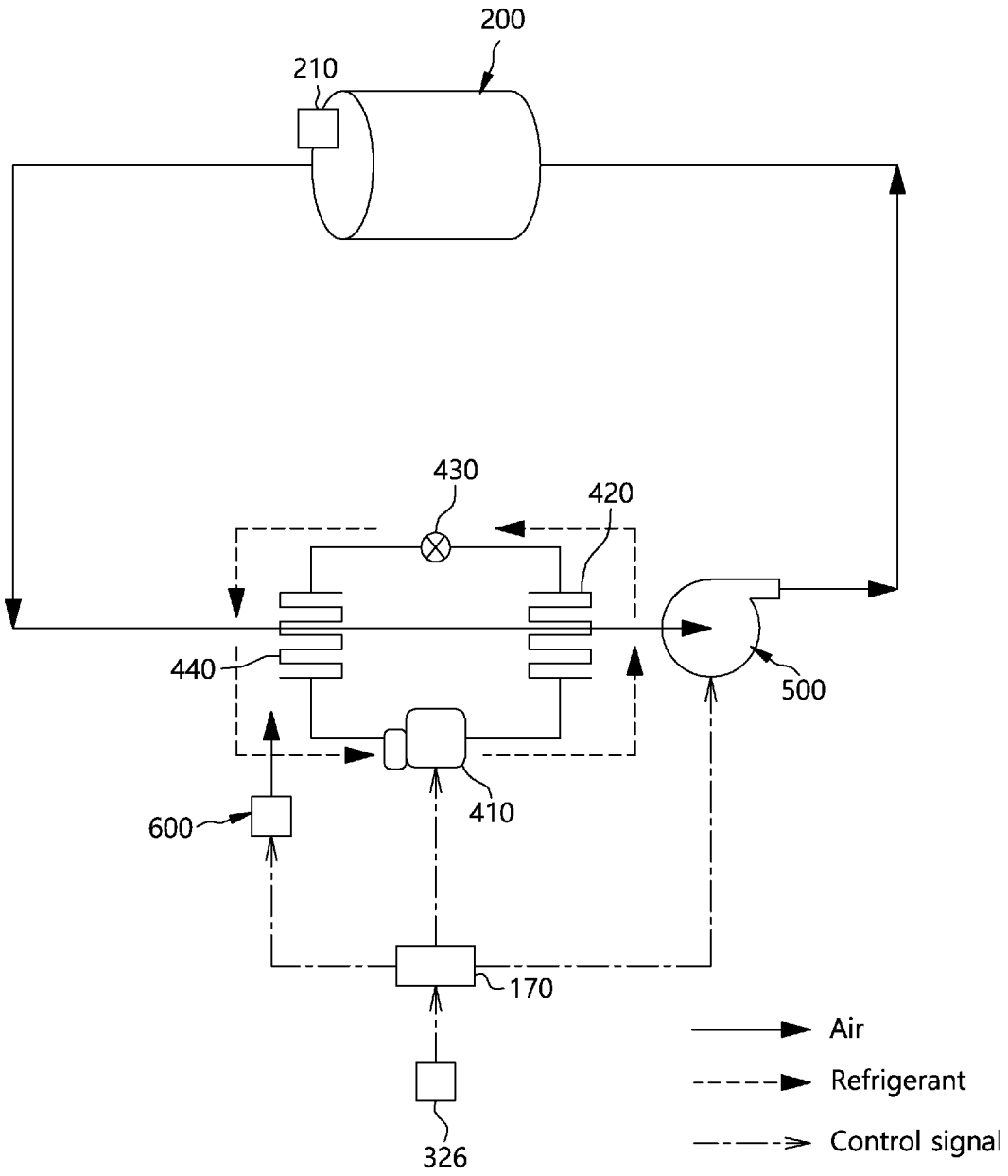
FIG. 2 is a block diagram schematically showing a structure for drying and washing operations by the laundry processing apparatus according to the embodiment of the present disclosure.
Figure 3:
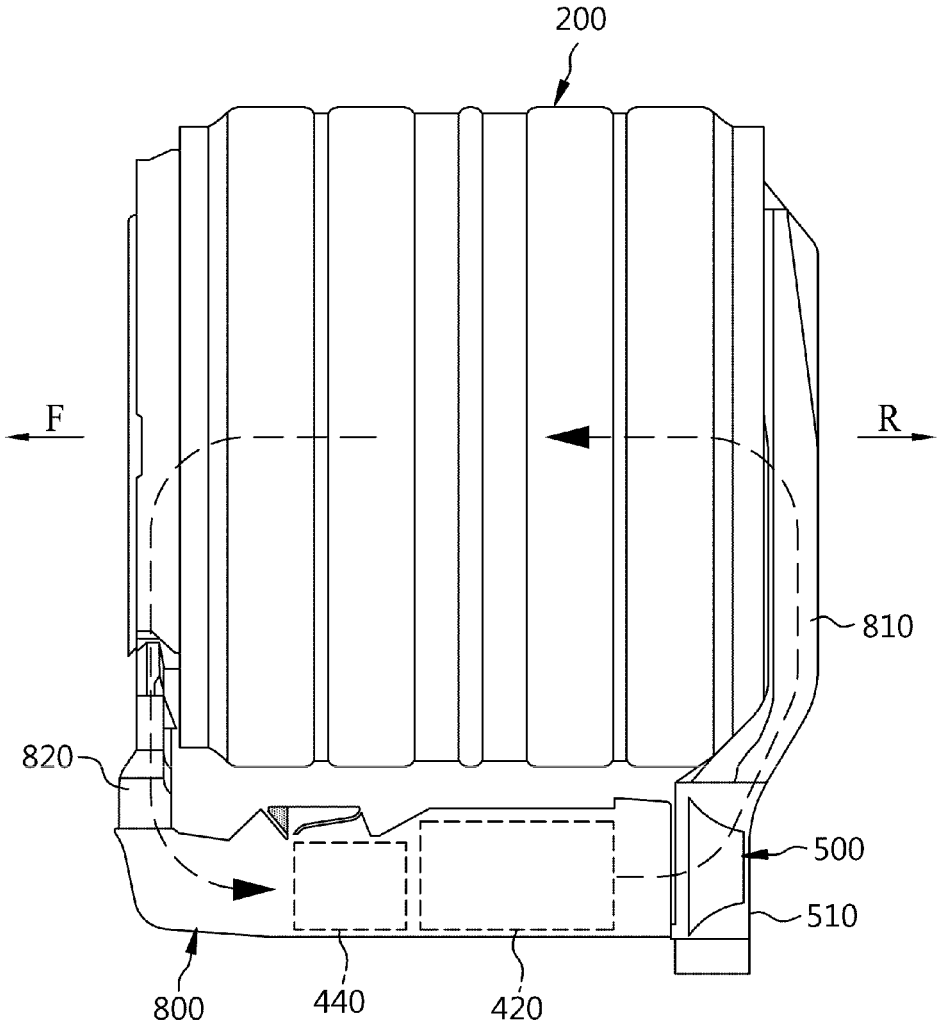
FIG. 3 is a side view showing a brief structure for the drying operation by the laundry processing apparatus according to the embodiment of the present disclosure.
Figure 4:
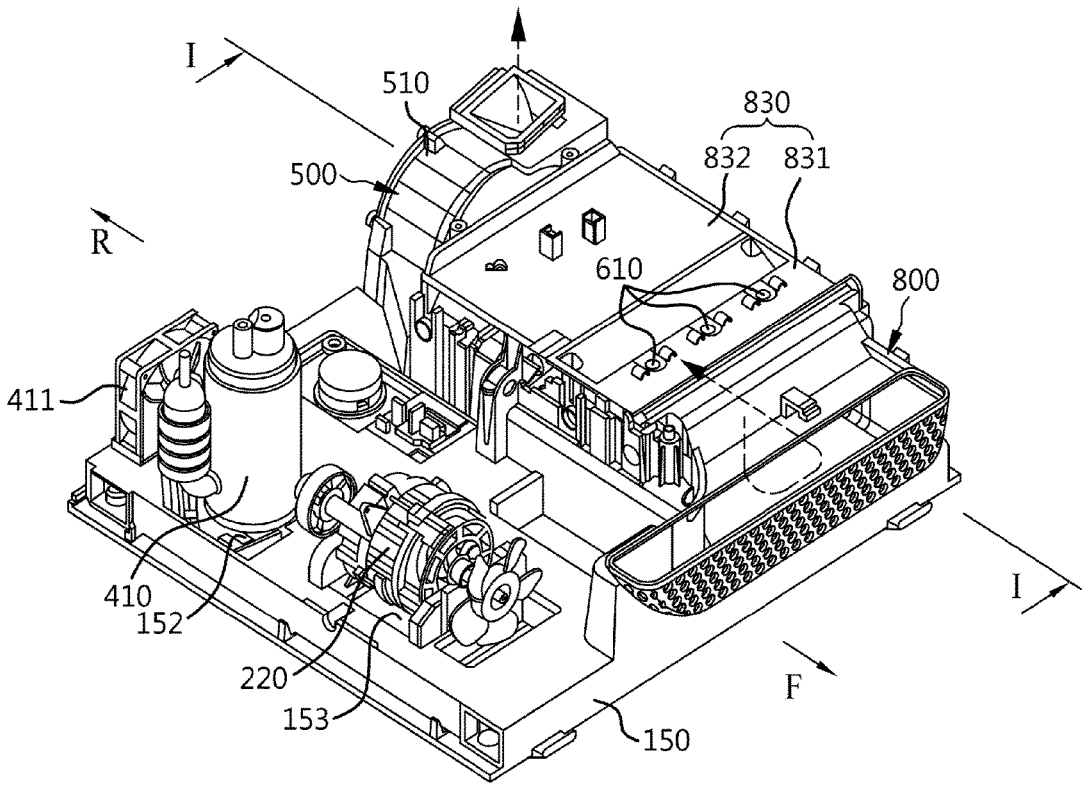
FIG. 4 is a perspective view showing a heat pump system of the laundry processing apparatus according to the embodiment of the present disclosure.
Figure 5:
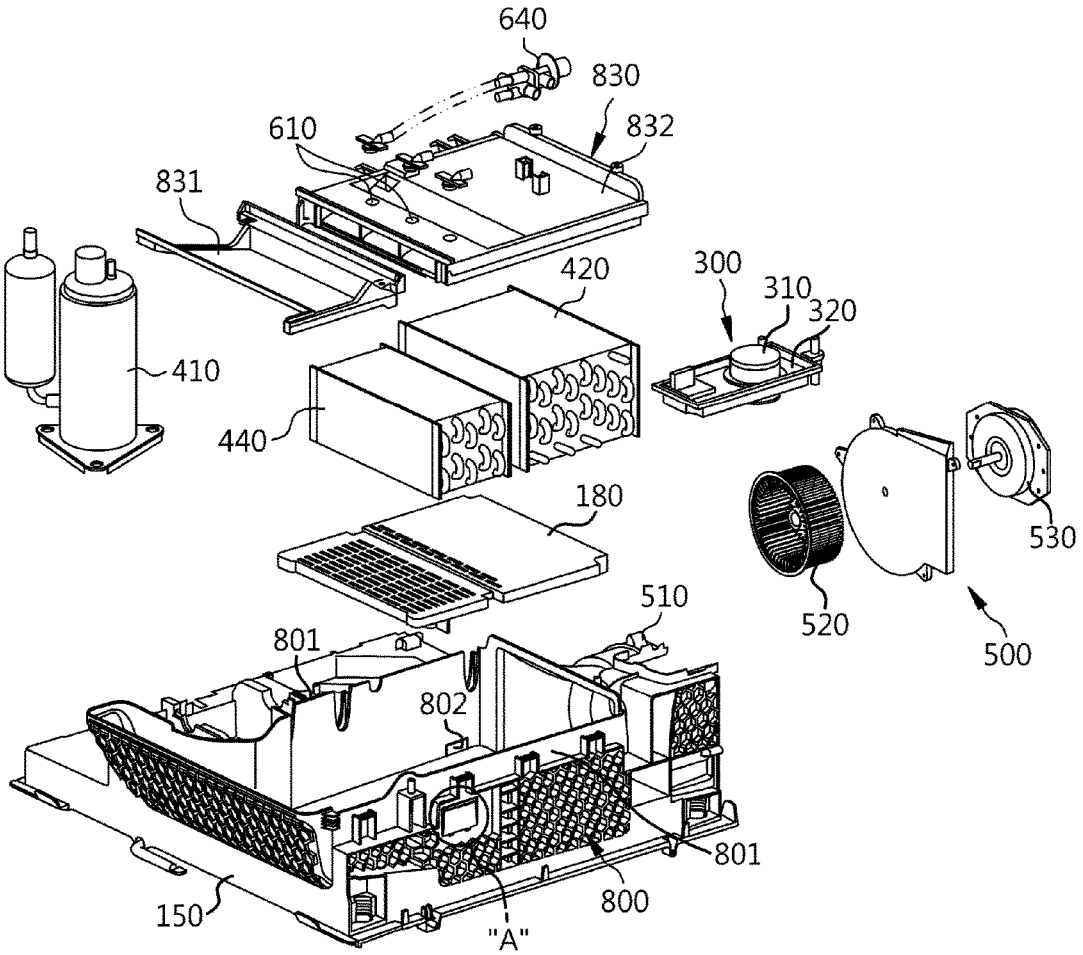
FIG. 5 is an exploded-perspective view showing the heat pump system of the laundry processing apparatus according to the embodiment of the present disclosure.
Figure 6:
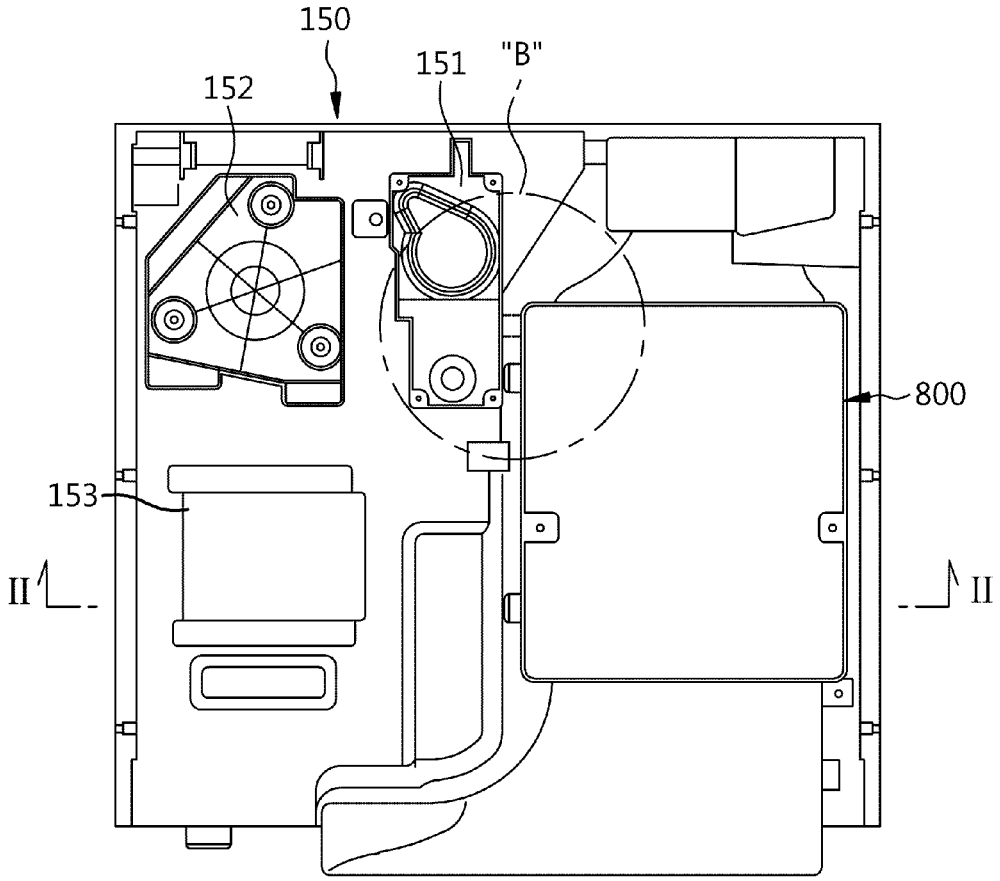
FIG. 6 is a plan view showing a base frame of the laundry processing apparatus according to the embodiment of the present disclosure.
Figure 7:
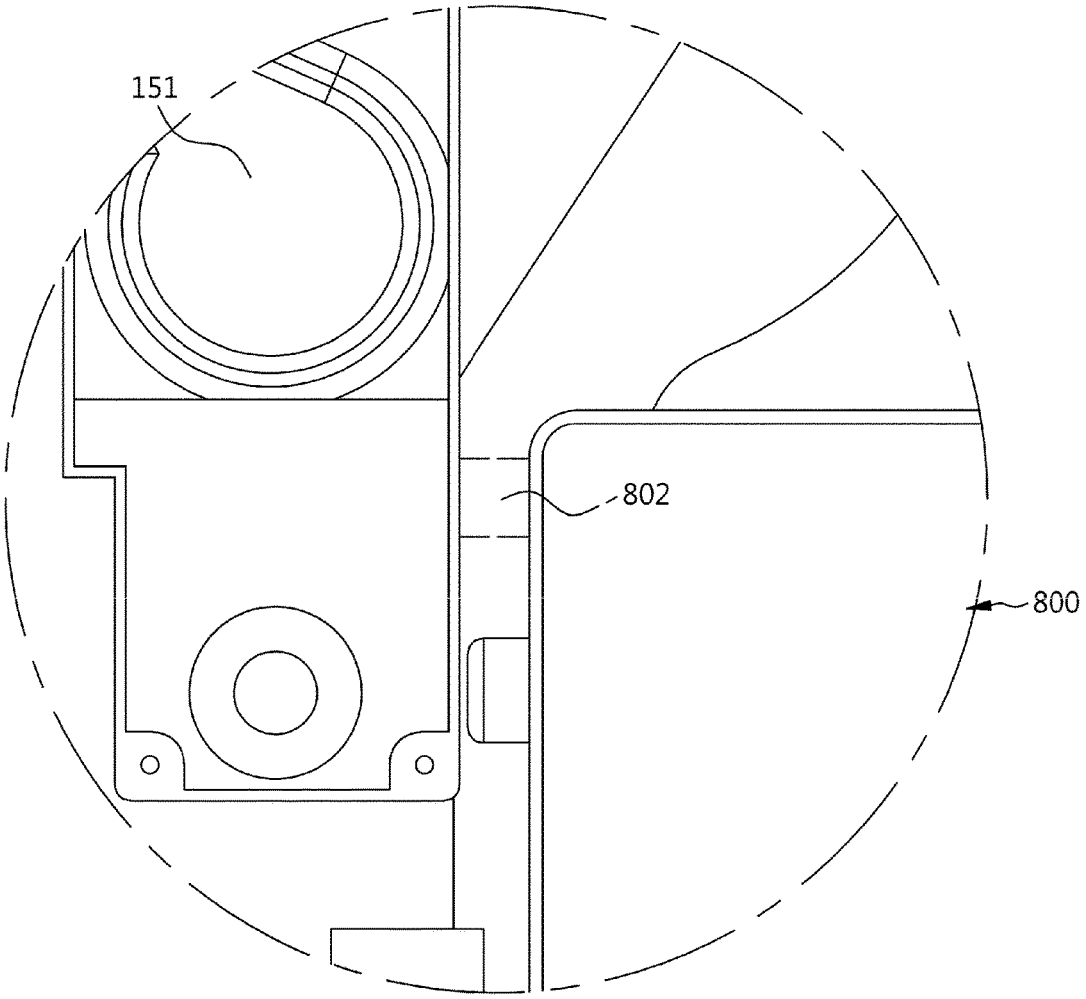
FIG. 7 is an enlarged view showing part "B" in FIG. 6.

Each of FIGS. 1 to 6 depicts a structure of each part of the laundry processing apparatus according to the embodiment of the present disclosure. FIG. 1 is a perspective view showing an interior structure of the laundry processing apparatus according to the embodiment of the present disclosure. FIG. 2 is a block diagram schematically showing a structure for drying and washing operations by the laundry processing apparatus according to the embodiment of the present disclosure. FIG. 3 is a side view showing a brief structure for the drying operation by the laundry processing apparatus according to the embodiment of the present disclosure. FIG. 4 is a perspective view showing a heat pump system of the laundry processing apparatus according to the embodiment of the present disclosure. FIG. 5 is an exploded-perspective view showing the heat pump system of the laundry processing apparatus according to the embodiment of the present disclosure. FIG. 6 is a plan view showing a base frame of the laundry processing apparatus according to the embodiment of the present disclosure.

As shown in the drawings, the laundry processing apparatus according to the embodiment of the present disclosure is configured as follows. An opening hole 701, 702 that is open to communicate with an inside space of a cabinet 100 of the apparatus is formed on a wall defining a condensed water collecting space in which condensed water exists. The opening hole 701, 702 is configured to be opened and closed by an opening and closing unit 710, 720. In the embodiments of the present disclosure, the opening and closing unit may be configured as a swing door. Therefore, in the following description, the opening and closing unit will be referred to simply as "swing door").

That is, the opening hole 701, 702 is formed on the wall of the condensed water collecting space, so that the condensed water remaining in the condensed water collecting space may be quickly removed by air inside the cabinet 100 when the laundry processing apparatus is not operated. The opening hole 701, 702 is configured to be closed by the swing door 710, 720 during the drying operation, so that pressure leakage may be prevented for a space where air flow or a space where the condensed water is pumped.

Referring to the above drawings, the structure of the laundry processing apparatus according to the embodiment of the present disclosure having the above described features will be described in detail for each configuration as follows.

First, the laundry processing apparatus according to the embodiment of the present disclosure may include the cabinet 100.

As shown in FIG. 1, the cabinet 100 is a part making an exterior of the laundry processing apparatus.

The cabinet 100 is formed in a hollow container body and a drum 200 in which clothing to be dried is received is rotatably installed in the cabinet 100.

Herein, a front surface of the cabinet 100 includes a laundry entrance 101 through which the clothing to be dried is introduced into the drum 200. The laundry entrance 101 is configured to be opened and closed by a door 120.

Further, the cabinet 100 may include a drainage container 160 therein.

The drainage container 160 is a container which temporarily stores water to be drained (water for drainage).

The drainage container 160 is configured to be pullable and pushable at one side of an upper end in the drum 200. That is, the drainage container 160 may be pulled and pushed to drain depending on user needs.

Further, a base frame 150 may be provided at a lower end of the cabinet 100.

The base frame 150 may be configured to form a bottom portion in the cabinet 100. Although not shown, a separate bottom plate may be provided to close an open lower surface of the cabinet 100 and the base frame 150 may be seated on and fixed to the bottom plate.

In particular, at least one structure of a drainage pump assembly 300, the heat pump system, a circulation fan assembly 500, and a circulation flow path 800, which will be described below, may be installed or formed on an upper surface (bottom surface in the cabinet) of the base frame 150, as shown in FIGS. 4 to 6.

A plurality of depressed portions is provided on the upper surface of the base frame 150. The depressed portions include a depressed portion 152 for installing a compressor 410, a depressed portion 153 for installing a motor 220 for operating a drum, and a depressed portion for installing the drainage pump assembly 300, as shown in FIGS. 4 to 6.

Herein, the depressed portion for installing the drainage pump assembly 300 may be used as the condensed water collecting part 151 for storing the water for drainage. The water for drainage may be water generated during the drying operation or condensed water generated during the heat exchange of air.

That is, during the drying operation, the condensed water is generated on a surface of an evaporator 440 of the heat pump system through which humid air passes. The condensed water flows down along the surface of the evaporator 440 and then is stored in the condensed water collecting part 151 that is formed by being depressed on the base frame 150.

Meanwhile, the circulation flow path 800 may be provided at one side of the upper surface of the base frame 150.

The circulation flow path 800 is configured such that, the evaporator 440 and a condenser 420 of the heat pump system are sequentially installed in the circulation flow path 800. Further, the circulation flow path 800 may be formed in a duct-type structure (referring to FIG. 5) having left and right wall surfaces 801 for guiding flow of air to flow through the evaporator 440 and the condenser 420 in order.

An upper surface of the circulation flow path 800 is formed to be open, and a bottom surface in the circulation flow path 800 is formed as the upper surface of the base frame 150.

The shape of the circulation flow path 800 may be formed in various structures, such as a cylindrical duct as well as a box duct with an open upper surface, considering shapes of peripheral structures or flow characteristic of air.

An inlet duct 810 guiding dried air to be supplied into the drum 200 may be connected to an air outflow side, that is, a rear side of the circulation flow path 800, and an outlet duct 820 guiding discharge flow of air discharged from the drum 200 may be connected to an air inflow side, that is, a front side of the circulation flow path 800, as shown in FIG. 1.

The open upper surface of the circulation flow path 800 may be configured to be closed by being covered with a base cover 830 (referring to FIGS. 4 and 5). That is, the inside of the circulation flow path 800 has a closed space from the outside environment by the base cover 830 described above.

Further, a seating depression 154 is formed by being depressed on the bottom surface in the circulation flow path 800. A water cover 180 on which at least one of the evaporator 440 and the condenser 420 is seated and fixed thereto may be provided in the seating depression 154.

A passing hole 802 (referring to FIGS. 8 and 12) communicating with an inside of the condensed water collecting part 151 may be formed on a rear side wall of the seating depression 154.

Therefore, the condensed water or washing water falling to the bottom in the circulation flow path 800 flows down to the seating depression 154 and then flows backwards along a bottom surface in the seating depression 154. Continuously, the condensed water or washing water may be collected and stored in the condensed water collecting part 151 while passing through the passing hole 802.

The bottom surface of the seating depression 154 may be formed to be inclined toward a portion where the condensed water collecting part 151 is positioned.

Accordingly, the condensed water and washing water flowing down to the bottom surface in the seating depression 154 may smoothly flow down to the condensed water collecting part 151 along the inclined bottom surface of the seating depression 154.

In addition, residual water stored in the condensed water collecting part 151 may be drained into the drainage container 160 after all operations.

At this time, when washing operation for washing the evaporator 440 is performed, the residual water is not drained to the drainage container 160, but is used as the washing water for the washing operation.

Meanwhile, a controller 170 is provided inside the cabinet 100.

The controller 170 is provided for operation control of the laundry processing apparatus.

The controller 170 is configured to control the operation of the laundry processing apparatus on the basis of manipulation of a user which is applied through an input part 140 of the cabinet 100.

Further, the controller 170 is programmed to perform drainage operation to pump and drain the residual water stored in the condensed water collecting part 151 by performing the drying operation for the clothing to be processing while controlling operations of the circulation fan assembly 500 and the compressor 410 and by controlling operation of a drainage pump 310 on the basis of a water level confirmed by a water level sensor 326. At this time, the water level sensor 326 is provided in the drainage pump assembly 300 and to detect the water level of the condensed water in the condensed water collecting part 151.

The laundry processing apparatus according to the embodiment of the present disclosure may include the drum 200.

As shown in FIGS. 1 and 3, the drum 200 may be formed in a cylindrical container body having openings at front and rear surfaces thereof.

A front opening of the drum 200 may communicate with the laundry entrance 101 of the cabinet 100. At this time, the drum 200 is configured such that rotation thereof is supported using a roller 201 in the cabinet 100.

In addition, the drum 200 may be configured such that high temperature and dry air passes through an inside of the drum 200.

The high temperature and dry air is configured to flow into the inside space of the drum 200 through a rear opening of the drum 200 and then to be discharged to the outside of the drum 200 through the front opening of the drum 200.

Further, the circulation flow path 800 via the evaporator 440 and the condenser 420 of the heat pump system, which will be described below, may be connected to the front and rear openings of the drum 200.

That is, the high temperature and dry air provided from the heat pump system by the circulation flow path 800 dries the clothing to be dried in the drum 200. Humid air having moisture while drying the clothing to be dried is supplied to the heat pump system again to repeat the operation. The above process is as shown in FIG. 2.

Meanwhile, a dryness degree detecting part 210 may be provided inside the drum 200.

The dryness degree detecting part 210 is configured to confirm the degree of dryness of the clothing to be dried, and may include two electrodes. The two electrodes may be spaced apart from each other and be exposed toward the inside of the drum 200.

For example, the dryness degree detecting part 210 may be provided at the door 120 or at a door side of the cabinet 100.

The dryness degree detecting part (two electrodes) 210 determines the degree of dryness of the clothing to be dried on the basis of an electrode value converted on the basis of a current value that varies in response to a state of the clothing to be dried (for example, degree of wetness of laundry) when the clothing to be dried is brought into contact with the electrodes.

That is, considering that the clothing to be dried acts as resistance to the dryness degree detecting part (two electrodes) 210, since a resistance value varies in response to moisture content of the clothing to be dried, the current flowing through a circuit also varies. The variation value of the variable current is converted into a preset electrode value, so that the degree of dryness is determined by the electrode value.

At this time, the preset electrode value may be a predetermined value converted into a numerical range that is easy to control the laundry processing apparatus.

The laundry processing apparatus according to the embodiment of the present disclosure may include the drainage pump assembly 300.

The drainage pump assembly 300 is provided to pump the condensed water stored in the condensed water collecting part 151. The drainage pump assembly 300 is received and mounted in the condensed water collecting part 151.

Further, the drainage pump assembly 300 includes the drainage pump 310 and a pump cover 320.

Although not shown in detail, the drainage pump 310 is configured to pump the condensed water stored in the condensed water collecting part 151 by rotation of an impeller due to driving of a drainage motor.

The laundry processing apparatus according to the embodiment of the present disclosure may include the heat pump system.

As shown in FIG. 2, the heat pump system is configured to receive humid air discharged from the drum 200 and perform heat exchange for the humid air, so that the humid air is changed into high temperature and dry air.

That is, air supplied into the drum 200 by the heat pump system may always be in a high temperature and dry state.

The heat pump system may include at least one configuration of the compressor 410, the condenser 420, an expansion valve 430, and the evaporator 440.

The compressor 410 is a device that receives high temperature and low pressure refrigerant and compresses it into high temperature and high pressure refrigerant for the heat exchange.

The condenser 420 is a device that receives the high temperature and high pressure refrigerant and condenses it into low temperature and high pressure refrigerant.

The expansion valve 430 is a device that receives the condensed low temperature and high pressure refrigerant and expands it into low temperature and low pressure refrigerant.

The evaporator 440 is a device that receives the low temperature and low pressure refrigerant and perform the heat exchange between surrounding air and the low temperature and low pressure refrigerant.

The refrigerant passing through the evaporator 440 is into a high temperature and low pressure state, and the high temperature and low pressure refrigerant repeats circulation of providing into the compressor 410.

The compressor 410 and the expansion valve 430 may be positioned at either one side of an upper surface of the base frame 150 (referring to FIG. 5).

Figure 12:
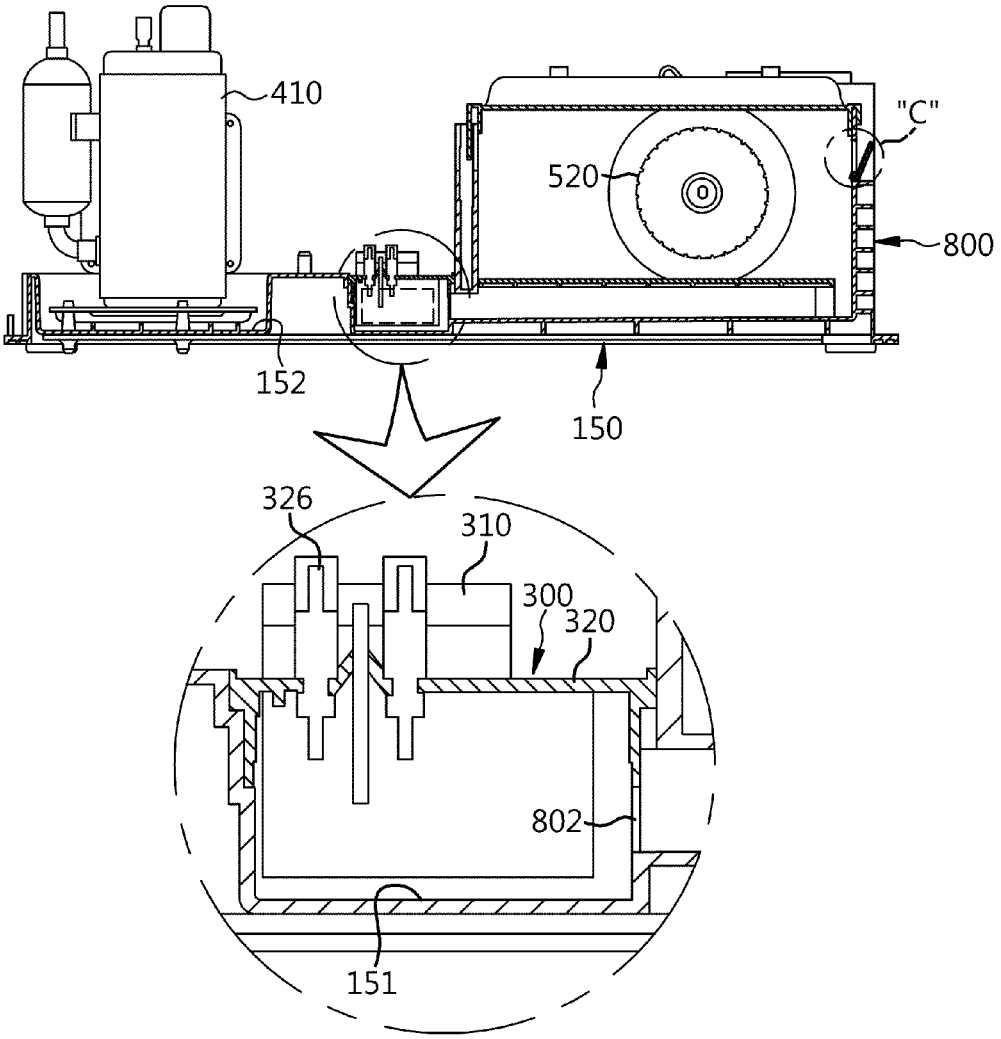
FIG. 12 is a section view showing line II-II in FIG. 6.

The condenser 420 and the evaporator 440 may be positioned in the circulation flow path 800 (referring to FIGS. 4 and 12).

The evaporator 440 is arranged at a side in the inside space of the circulation flow path 800 into which humid air is introduced, and serves to remove moisture in the air by performing heat exchange between the air and the low temperature and low pressure refrigerant.

The condenser 420 is arranged at an air outflow side of the evaporator 440 and serves to heat the dry air that is decreased in temperature while passing through the evaporator 440.

Considering that the compressor 410 is a device generating a large amount of heat during operation thereof, the compressor 410 may be positioned to be adjacent to a radiating fan 411 provided for radiation of heat of the compressor 410. Thereby, the compressor 410 may radiate heat by the radiating fan 411.

The compressor 410 and the expansion valve 430 are positioned at separate positions from the circulation flow path 800 and do not affect the circulated air (flow and temperature of air).

The laundry processing apparatus according to the embodiment of the present disclosure may include the circulation fan assembly 500.

The circulation fan assembly 500 is a configuration that forcibly circulates air.

That is, air that sequentially passes through the evaporator 440 and the condenser 420 in the circulation flow path 800 by the driving of the circulation fan assembly 500 is supplied into the drum 200 through the inlet duct 810. Further, air passing through the drum 200 is circulated to sequentially pass through the evaporator 440 and the condenser 420 in the circulation flow path 800 through the outlet duct 820.

As shown in FIG. 4, the circulation fan assembly 500 may be positioned at an air outflow side of the condenser 420 in the circulation flow path 800.

In particular, the circulation fan assembly 500 may include a circulation fan 520 provided in a fan housing 510 and a fan motor 530 provided to drive the circulation fan 520. An inlet of the fan housing 510 is connected to the circulation flow path 800, and an outlet thereof is connected to the inlet duct 810.

The laundry processing apparatus according to the embodiment of the present disclosure may include a washing unit 600.

The washing unit 600 is a device that washes the evaporator 440 with the residual water in the condensed water collecting part 151.

Figure 8:
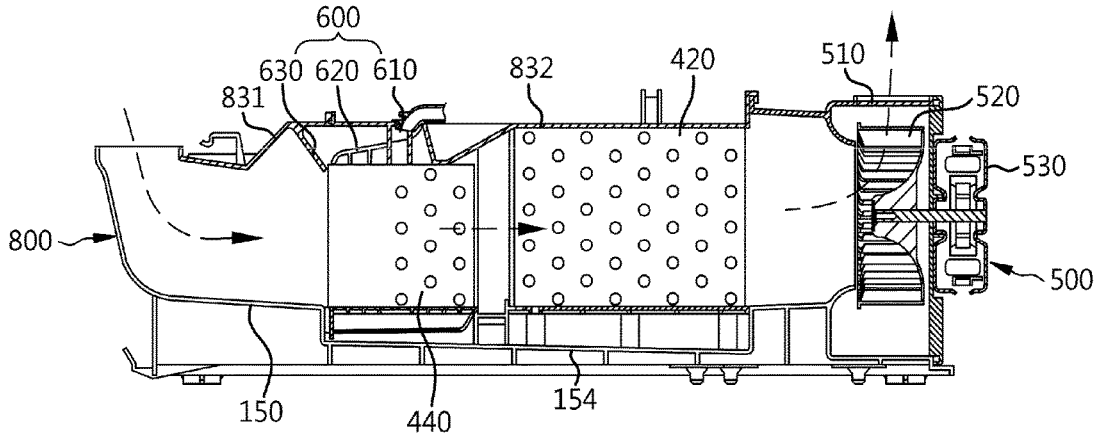
FIG. 8 is a section view taken along line I-I in FIG. 4.

As shown in FIGS. 5 and 8, the washing unit 600 may be provided on a base cover 830 covering the open upper surface of the circulation flow path 800.

The washing unit 600 is configured to wash an air inflow portion (front surface) of the evaporator 440 while releasing the residual water to the front surface of the evaporator 440.

At this point, the base cover 830 includes a front base cover 831 making a front side portion of the base cover 830 and a rear base cover 832 making a rear side portion thereof.

The washing unit 600 may include an inflow hole 610 and a nozzle part 620 that are provided at the rear base cover 832, and a guide end 630 provided at the front base cover 831.

The inflow hole 610 is a portion where the residual water flows into, and the nozzle part 620 is a portion guiding the residual water flowing in the washing unit 600 through the inflow hole 610 to fall to the front surface of the evaporator 440.

The nozzle part 620 has a structure in which the nozzle part is gradually inclined (or rounded) down from a rear portion (right side in the drawings) where the nozzle part communicates with the inflow hole 610 to a front portion (left side in the drawings). In addition, a front side end of the nozzle part may be formed to be further inclined (rounded) down than other portions.

The evaporator 440 may be provided such that the front surface thereof is positioned directly under the front side end of the nozzle part 620. The front surface of the evaporator 440 is a surface in a direction where humid air flowing through the circulation flow path 800 flows into the evaporator 440.

The inflow hole 610 may be configured to receive the residual water in the condensed water collecting part 151 from a flow path valve 640 through a hose (not shown) or a separate flow path.

The inflow hole 610 may include at least two holes. The flow path valve 640 is configured to perform control for selective supply or simultaneous supply of the condensed water to each inflow hole 610.

In particular, by receiving the control of the controller which will be described below, the flow path valve 640 may guide the residual water pumped from the drainage pump assembly to flow into the inflow hole 610 or flow into the drainage container 160.

Although not shown in the drawings, the inflow hole 610 may be configured to directly receive tap water through a water pipe or to separately receive water or washing product from a reservoir where other water or washing product is stored.

Further, the guide end 630 is provided at a portion in the front base cover 831 which faces the nozzle part 620 and servers to guide the residual water flowing down along the nozzle part 620 to direct to the front surface of the evaporator 440.

The guide end 630 may be gradually inclined down toward the rear (right side in the drawings). Although not shown, a rear side end of the guide end 630 may be formed to be further inclined (inclined close to vertical) than other portions.

The laundry processing apparatus according to the embodiment of the present disclosure may include the swing door 710, 720.

The swing door 710, 720 is configured to selectively open and close a space (condensed water collecting space) of each portion in the cabinet 100, which has a separate space partitioned from the inside of the cabinet 100 and receives the condensed water to be present therein, from inside environment of the cabinet 100.

In particular, the opening hole 701, 702 being open to communicate with the inside space of the cabinet 100 is provided on the wall defining the condensed water collecting space in which the condensed water exists. The swing door 710, 720 is configured to open and close the opening hole 701, 702.

At this time, the condensed water collecting space may be a space in the circulation flow path 800 through which the condensed water flows or a space in the condensed water collecting part 151 in which the condensed water is stored.

In the embodiment of the present disclosure, the opening hole and the swing door may include a first opening hole 701 provided on any one wall surface 801 of opposite wall surfaces forming the circulation flow path 800 and a first swing door 710 opening and closing the first opening hole 701.

That is, the inside of the circulation flow path 800 includes a space partitioned from the inside space of the cabinet 100, and the condensed water that is generated while air passes through the evaporator 440 exists in the inside of the circulation flow path 800.

Considering the above description, when the inside space (condensed water collecting space) of the circulation flow path 800 is maintained in a state of being shielded from the inside space of the cabinet 100, the condensed water existing in the inside space of the circulation flow path 800 is not removed and remains for a long time.

It is possible that the condensed water remaining in the inside space of the circulation flow path 800 is quickly removed by outside air in the cabinet 100 by opening the inside space of the circulation flow path 800 and the inside space of the cabinet 100 to each other.

However, since the inside space of the circulation flow path 800 is a space where air performs the heat exchange while passing through the evaporator 440 or the condenser 420, the space should be configured to have sufficient pressure and to be quickly ventilated.

Considering the above description, when the inside space of the circulation flow path 800 is formed to be open from the inside space of the cabinet 100, there is a problem that air does not smoothly heat-exchange with the evaporator 440 or the condenser 420 due to pressure leakage, and the above state is not preferable.

Therefore, the first opening hole 701 (referring to FIG. 10) may be formed on either wall surface of the circulation flow path 800, and the first opening hole 701 may be closed by the first swing door 710 during the drying operation.

Figure 9:
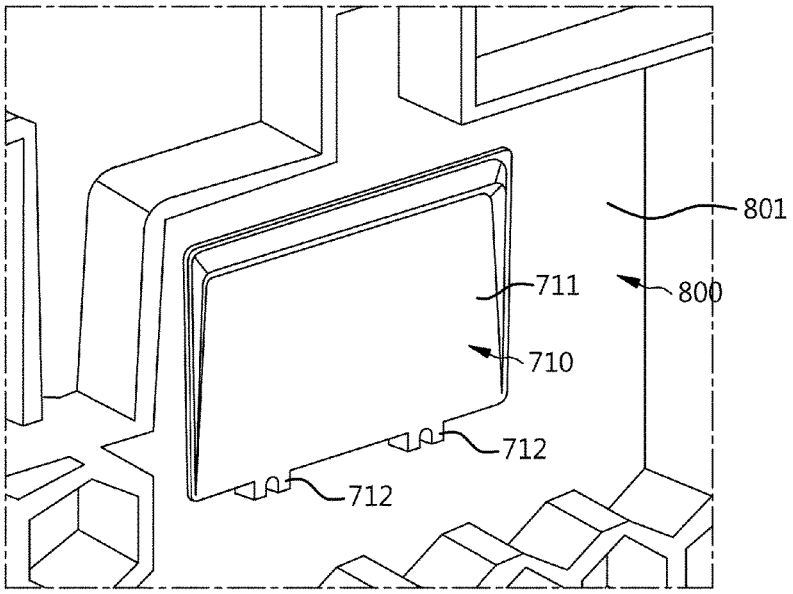
FIG. 9 is an enlarged view showing part "A" in FIG. 5.
Figure 10:
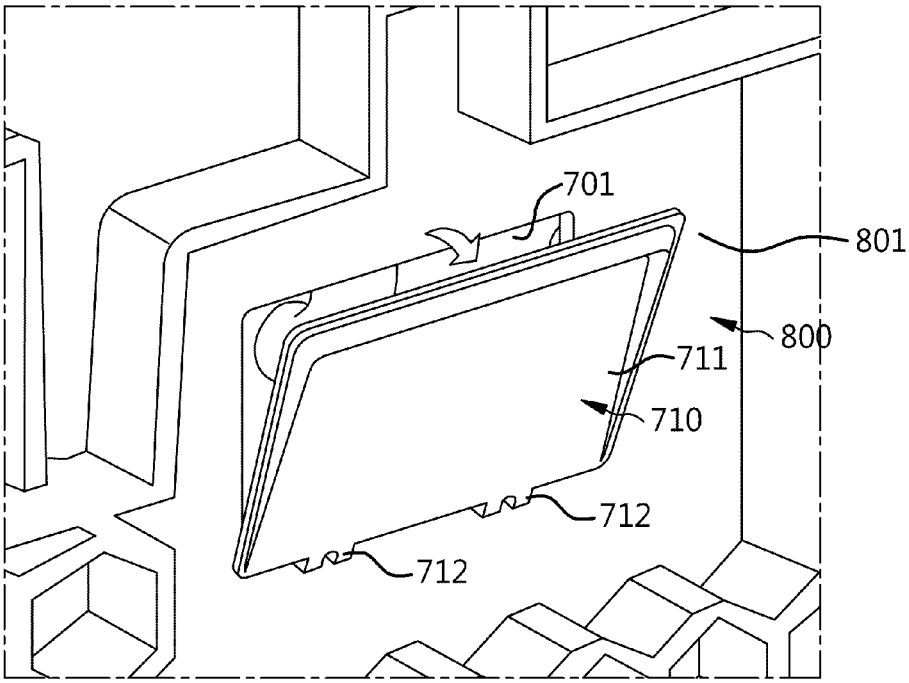
FIG. 10 is an enlarged main part view showing a state of a first opening and closing unit during a non-operated state of the laundry processing apparatus according to the embodiment of the present disclosure.

By the above structure, the pressure leakage in the circulation flow path 800 may be prevented as well as the circulation flow path 800 may be exposed to the outside during non-operation so that removal of the condensed water by inflow of outside air may be quickly performed. The above description is as shown in FIGS. 5, 9, and 10.

In particular, in the embodiment of the present disclosure, the first swing door 710 may be configured to close the first opening hole 701 by pressure in the condensed water collecting space.

That is, the first swing door 710 is not a device operated by electronic control, but is configured to selectively close the first opening hole 701 by the pressure inside the condensed water collecting space and its own weight.

Therefore, the first swing door 710 may include a flat contact plate 711 and a penetrating installation part 712 protruding from the contact plate 711.

That is, the contact plate 711 may cover the first opening hole 701 for closing it by the pressure inside the circulation flow path 800 or may be spaced apart from the first opening hole 701 by its own weight.

Preferably, the contact plate 711 may be formed of a plate of adhesive material such as rubber for airtightness.

When the contact plate 711 is formed of rubber, since bending occurs, the contact plate 711 formed of the flat plate material is preferably formed in a structure of adding a rubber plate 713 (referring to FIGS. 13 and 14) to an inner surface of the contact plate 711.

The rubber plate 713 may be formed in a structure that covers an entire inner surface of the contact plate 711 or a structure that covers only an edge portion of the inner surface of the contact plate 711.

Further, the first swing door 710 may be provided on an inner side of the wall surface 801 of the circulation flow path 800 or on an outer side of the wall surface 801 of the circulation flow path 800.

That is, when the inside space of the circulation flow path 800 is a structure having negative pressure during air flow, the first swing door 710 may be provided on the outer side of the circulation flow path 800 and may close the first opening hole 701 while being brought into contact with the wall surface due to the negative pressure.

When the inside space of the circulation flow path 800 is a structure having positive pressure during air flow, the first swing door 710 may be provided on the inner side of the circulation flow path 800 and may close the first opening hole 701 while being brought into contact with the wall surface due to the positive pressure.

The penetrating installation part 712 formed in the contact plate 711 may be configured to pass through an installation slot 803 (referring to FIG. 11) on the wall surface 801 where the first opening hole 701 is formed.

In particular, the penetrating installation part 712 may include a penetrating end 712*a* formed to have a width smaller than a width of the installation slot 803 and positioned to pass through the installation slot 803, and a locking end 712*b* formed by being extended or bent from an end of the penetrating end 712*a*.

Figure 11:
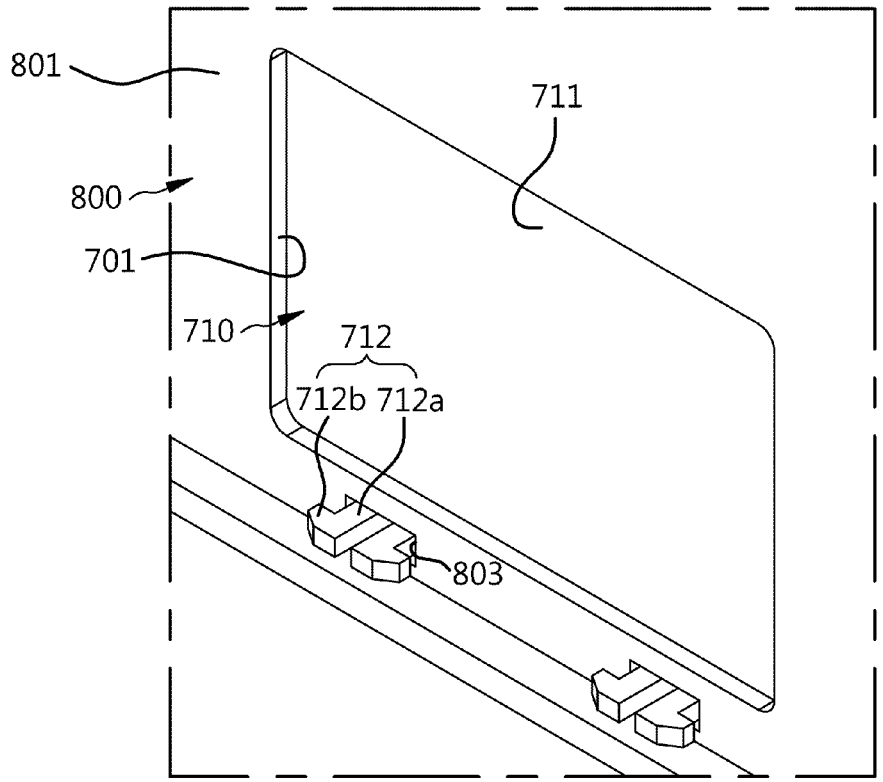
FIG. 11 is an enlarged main part view showing a state of the first opening and closing unit of the laundry processing apparatus according to the embodiment of the present disclosure, which is seen from the inside of a circulation flow path.

The locking end 712*b* may be provided to be exposed to the outside while passing through the installation slot 803 and to be locked by the wall surface 801. The above description is as shown in FIG. 11.

The penetrating installation part 712 may be formed by protruding from a lower circumference of the contact plate 711. Thus, the contact plate 711 closes or opens the first opening hole 701 while an upper end thereof is tilted back and forth around the penetrating installation part 712.

An upper end portion of the contact plate 711 may be formed heavier than a lower end portion thereof. That is, when the inside of the circulation flow path 800 is released from the negative pressure, the contact plate 711 is tilted backward due to its own weight thereby being spaced apart from the first opening hole 701.

A structure in which the upper end portion of the contact plate 711 is formed heavier than the lower end portion thereof may be variously provided.

For example, a part of the upper end portion of the contact plate 711 may be formed thicker than the lower end portion thereof.

Although not shown in the drawings, the penetrating installation part 712 may be formed at other portions of the contact plate 711 rather than the lower circumference thereof, and in this case, a center of gravity of the contact plate 711 may also vary.

Meanwhile, in the embodiment, the first swing door (or opening hole) 710 is provided only either wall surface 801 of the circulation flow path 800, but the present disclosure is not limited thereto.

That is, although not shown in the drawings, the first swing door 710 (or opening hole) may be provided on the both opposite wall surfaces 801 of the circulation flow path 800, and may be provided on at least two positions in either wall surface 801 of the circulation flow path 800.

However, it is most preferable that the first opening hole 701 is formed only on one or two positions, considering that the pressure leakage may occur during the drying operation when the first opening hole 701 is provided on multiple positions.

In particular, the first swing door (or opening hole) 710 may be a portion where the evaporator 440 is positioned of each portion of the circulation flow path 800.

As a result, since the condensed water is generated in the evaporator 440, the condensed water remaining on the surface of the evaporator 440 without flowing down may be quickly removed when the drying operation is finished.

Hereinafter, a process for the drying operation of the laundry processing apparatus according to the embodiment of the present disclosure will be described in detail.

Prior to the description, control of each operation element of each operation and sensors and valves is performed by the controller 170 on the basis of information preprogrammed, and in the following description, it is assumed that each control is performed by the controller 170 even if there is no special mention.

First, the drying operation is an operation of drying the clothing to be dried.

The drying operation is performed by manipulation of a user. That is, when the drying operation by manipulation of the user is selected, the controller 170 controls operations of the heat pump system and the circulation fan assembly 500.

That is, by a flow of refrigerant circulating in the heat pump system by the operation of the compressor 410 and a flow of air passing through the evaporator 440 and the condenser 420 in order by the operation of the circulation fan assembly 500, moisture contained in the air is removed and the dehydrated air under high temperature state is supplied into the drum 200 to dry the clothing to be dried.

Humid air discharged from the drum 200 flows into the circulation flow path 800 through the outlet duct 820 and then loses moisture while passing through the evaporator 440 positioned in the circulation flow path 800.

Continuously, the air repeats circulation of being heated while passing through the condenser 420, passing through the fan housing 510 provided in the circulation fan assembly 500 to flow into the inlet duct 810, and then being supplied into the drum 200.

Further, in the air circulation process, while the humid air passes through the evaporator 440, moisture contained in the air condenses on the surface (surface of each heat exchanger fin) of the evaporator 440, flows down along the surface, and falls down to the water cover 180, and then is collected in the seating depression 154. The collected condensed water flows to the rear side in the seating depression 154 by inclination of the bottom surface of the seating depression 154 and is stored in the condensed water collecting part 151 through the passing hole 802.

At this point, the water level sensor 326 provided in the condensed water collecting part 151 detects a water level of the residual water stored in the condensed water collecting part 151.

Then, based on the detected water level, the controller 170 determines whether the residual water in the condensed water collecting part 151 is drained to the drainage container 160 or not.

When the residual water is determined to be drained to the drainage container 160, the residual water is pumped to the drainage container 160 and stored therein by the operation of the drainage pump 310 and flow guide by the flow path valve 640.

Further, during performance of the drying operation, the inside space of the circulation flow path 800 is under a state of negative pressure by air suction force of the circulation fan 520.

That is, as the circulation fan 520 positioned at the rear side of the circulation flow path 800 is operated to forcibly suction air in the circulation flow path 800, the inside space of the circulation flow path 800 is under the state of negative pressure.

Figure 14:
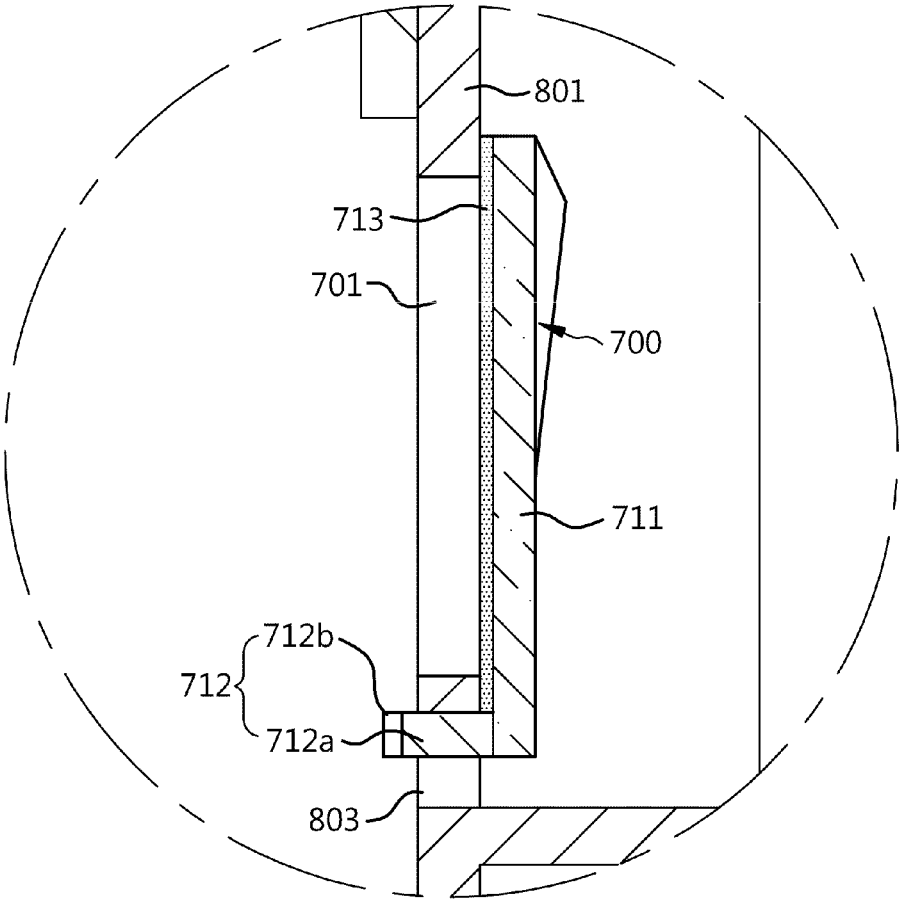
FIG. 14 is an enlarged main part view showing a state of the first opening and closing unit during the drying operation of the laundry processing apparatus according to the embodiment of the present disclosure.
Figure 15:
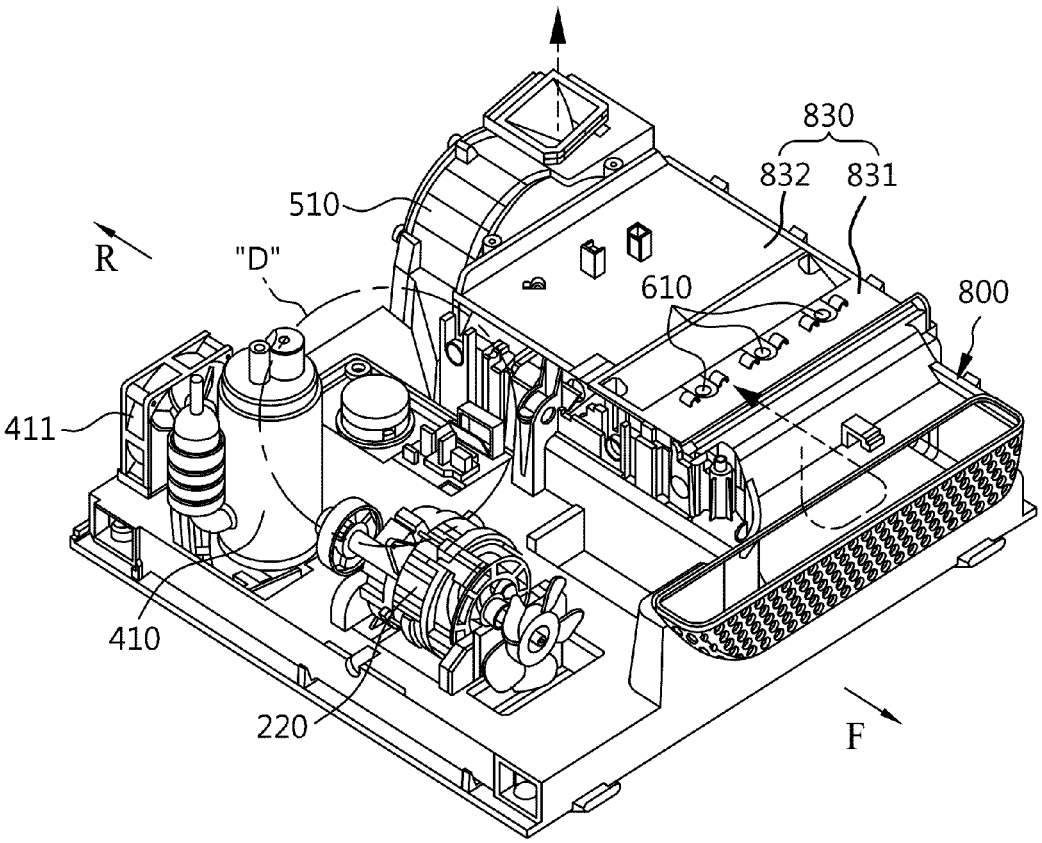
FIG. 15 is a perspective view showing an installation state of a second opening and closing unit of the laundry processing apparatus according to the embodiment of the present disclosure.
Figure 16:
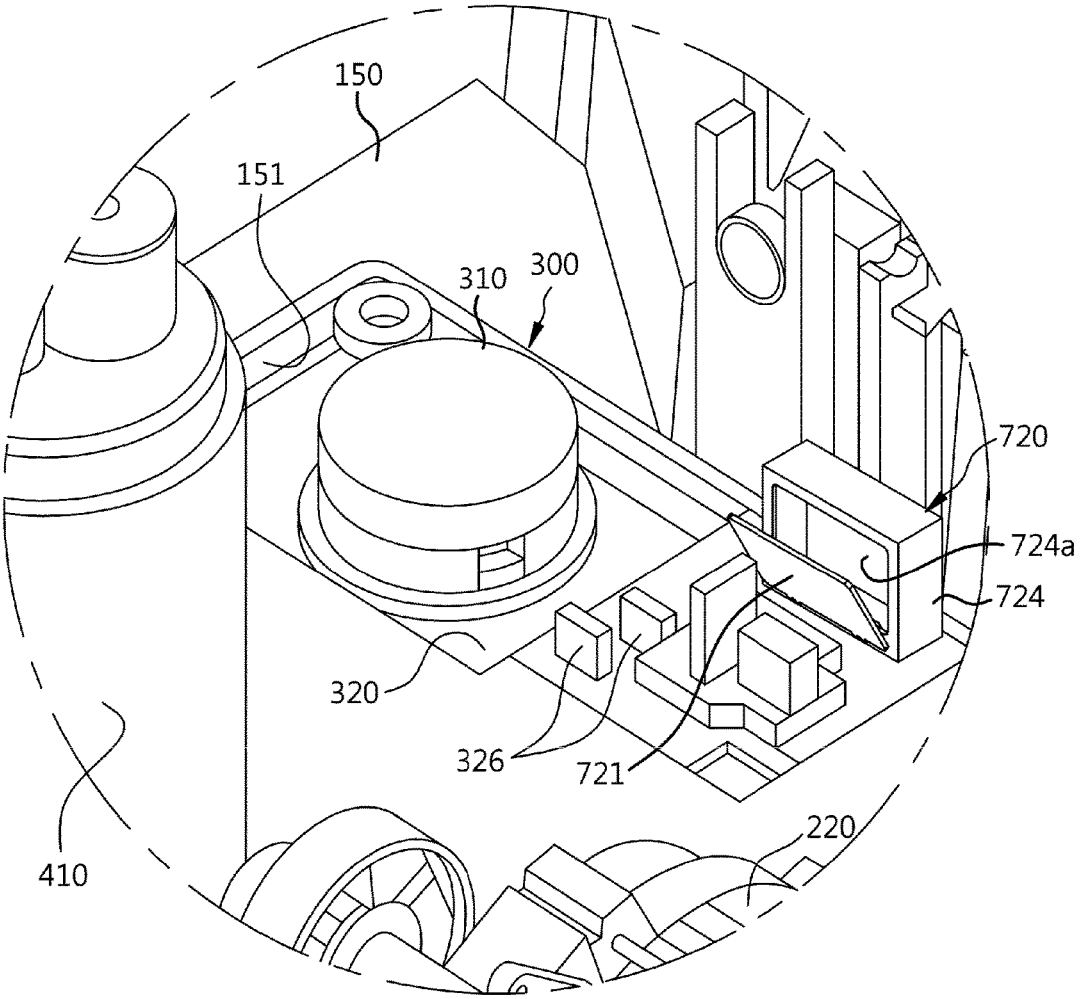
FIG. 16 is an enlarged view showing part "D" in FIG. 15.
Figure 17:
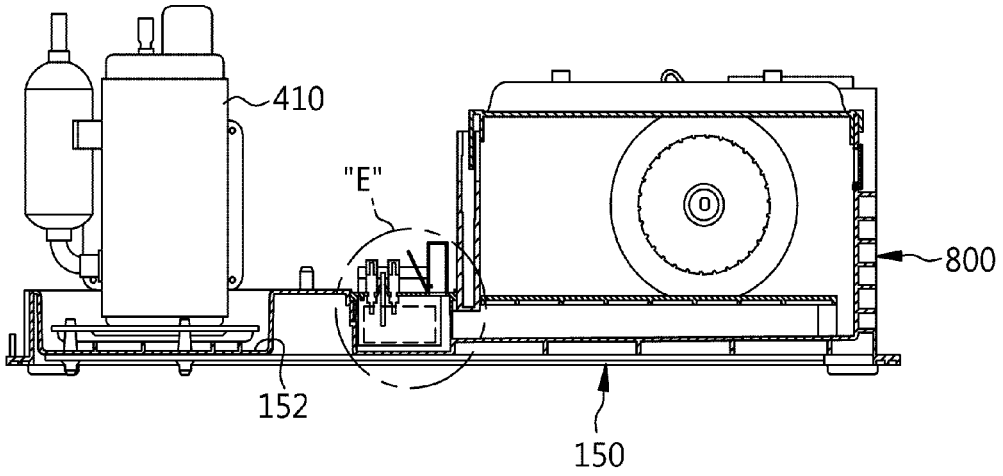
FIG. 17 is a section view showing an installation state of the second opening and closing unit of the laundry processing apparatus according to the embodiment of the present disclosure.
Figure 18:
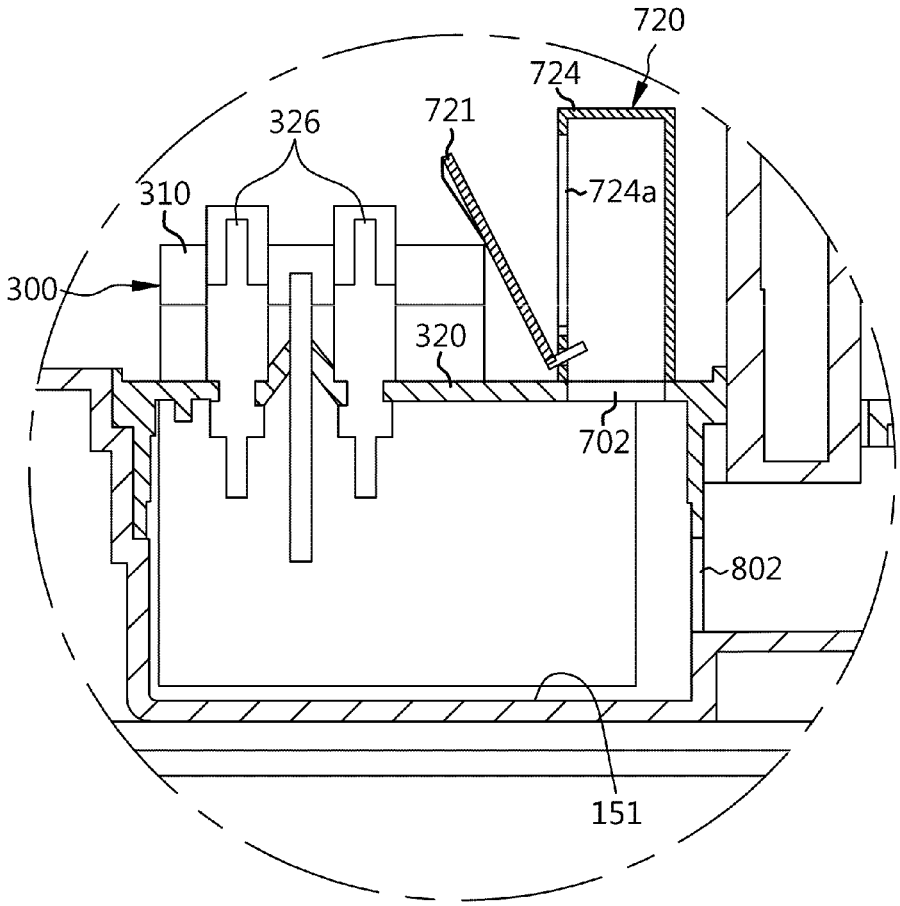
FIG. 18 is an enlarged view showing part "E" in FIG. 17.

Thus, the contact plate 711 of the first swing door 710 is in close contact with the outer wall surface of the circulation flow path 800 by receiving the air suction force in the circulation flow path 800 to close the first opening hole 701. Whereby, the pressure leakage through the opening hole 701 is prevented. The above description is as shown in FIGS. 9 and 14.

When the drying operation is finished and the operation of the circulation fan 520 stops, the inside space of the circulation flow path 800 is released from the state of negative pressure.

Accordingly, the air suction force that allows the contact plate 711 to be in close contact with the outer wall surface of the circulation flow path 800 is eliminated.

Figure 13:
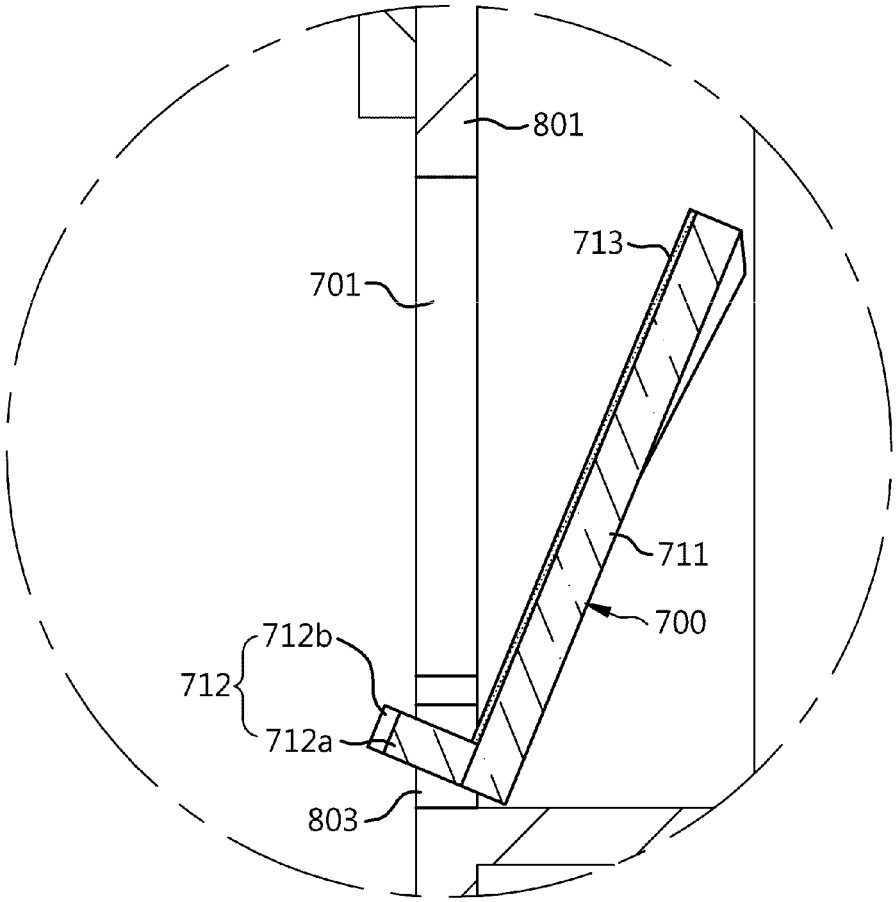
FIG. 13 is an enlarged view showing part "C" in FIG. 12.

When the air suction force is eliminated, the contact plate 711 is spaced apart from the first opening hole 701 while being tilted to the rear due to the weight of the upper end thereof. Accordingly, the first opening hole 701 is opened. The above description is as shown in FIGS. 10 and 13.

Accordingly, as air in the cabinet 100 is supplied into the circulation flow path 800 through the first opening hole 701, the humidity in the circulation flow path 800 is quickly reduced, thus the condensed water remaining in the circulation flow path 800 (in particular, the inside of the seating depression) may be quickly removed.

Further, when the drying operation is finished, the water level of the residual water stored in the condensed water collecting part 151 reaches above a preset water level or forced draining operation is performed by other algorithms, the condensed water stored in the condensed water collecting part 151 is pumped and stored in the drainage container 160 or is supplied into the washing unit 600 to be used for washing the evaporator 440 by the operation of the drainage pump 310 and the flow guide of the flow path valve 640.

Meanwhile, the inside space of the condensed water collecting part 151 where the drainage pump assembly 300 is provided is the condensed water collecting space where the condensed water is supplied through the seating depression 154 of the circulation flow path 800 and stored therein. Since the inside space of the condensed water collecting part 151 is a space closed from the outside environment by the drainage pump assembly 300, there is a problem that the condensed water stored therein is not easily removed and remains.

Considering the above problem, the drainage pump assembly 300 may include a second swing door 720.

That is, the second swing door 720 allows the condensed water collecting space in the condensed water collecting part 151 where the condensed water is stored to be in a selectively opened state from the inside space of the cabinet 100.

In particular, a second opening hole 702 is formed by passing through the pump cover 320 of the drainage pump assembly 300, so that the space (condensed water collecting space) in the condensed water collecting part 151 is configured to selectively communicate with the space in the cabinet 100. Herein, the second swing door 720 may be provided at a portion where the second opening hole 702 is formed.

The second opening hole 702 may be formed on either circumferential wall of the condensed water collecting part 151 and the second swing door 720 may be provided at the wall.

However, the above structure has leakage of the condensed water remaining in the condensed water collecting part 151 to the second opening hole 702, so the second opening hole 702 is preferably formed on the pump cover 320.

Further, the second swing door 720 may include a closed tube 724 and a contact plate 721. The second swing door 720 will be described in detail with reference to FIGS. 15 to 20.

First, the closed tube 724 is configured as a tubular body that has an open lower surface and a closed upper surface.

The open lower surface of the closed tube 724 covers the second opening hole 702 and an auxiliary hole **724*a* is formed by passing through a circumferential surface of the closed tube 724**.

That is, the second opening hole 702 is not formed directly on the circumferential surface of the condensed water collecting part 151, but a separate space communicating with the inside of the condensed water collecting part 151 is provided through additional provision of the closed tube 724. Outside air may be selectively provided into the condensed water collecting part 151 while the contact plate 721 selectively opens and closes the auxiliary hole **724*a* of the closed tube 724**.

Herein, the contact plate 721 of the second swing door 720 is provided on an outer wall surface of the closed tube 724 to cover the auxiliary hole **724*a*. In addition, a penetrating installation part 712 is formed at a lower circumference side of the contact plate 721 and is formed by passing through the outer wall surface of the closed tube 724 where the auxiliary hole 724*a*** is formed.

The auxiliary hole 724*a* formed in the closed tube 724 may be formed on either wall surface of opposite wall surfaces of the closed tube 724.

The wall of the closed tube 724 where the auxiliary hole 724*a* is formed may be a wall facing an inside of the drainage pump assembly 300 (wall opposite to wall facing circulation flow path). Although not shown, among each wall surface of the closed tube 724, a wall surface facing the circulation flow path 800 may have the auxiliary hole 724*a*.

Figure 19:
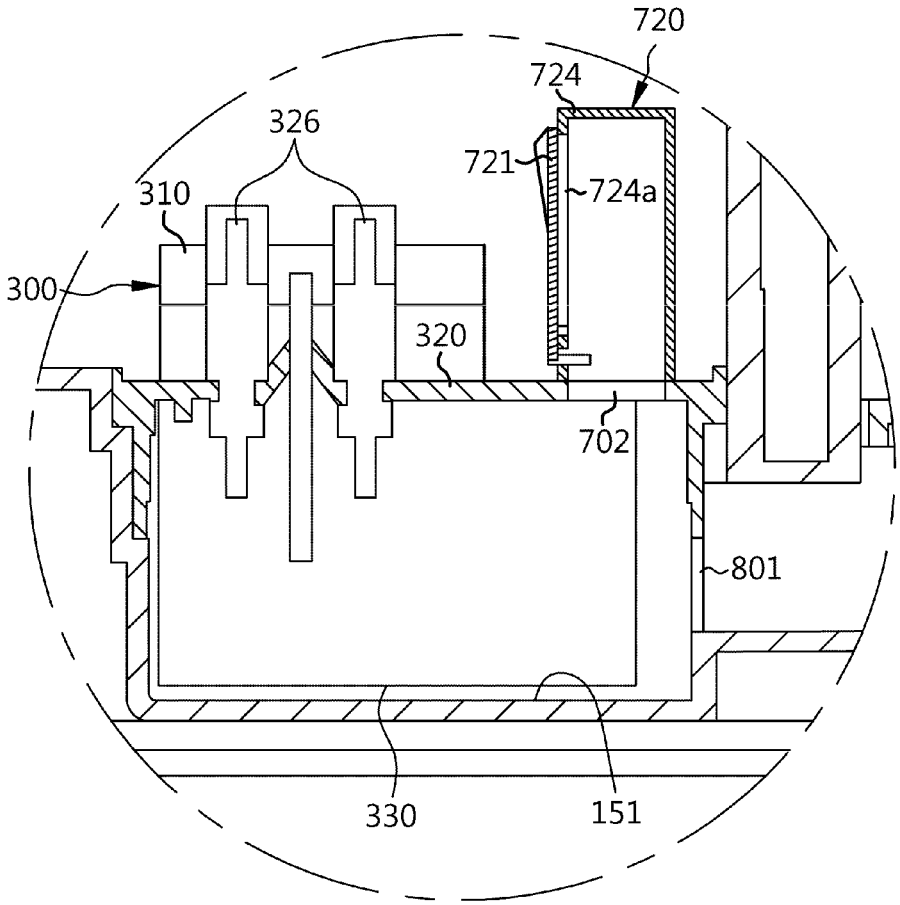
FIG. 19 is a section view showing an operational state of the second opening and closing unit in FIG. 18.
Figure 20:
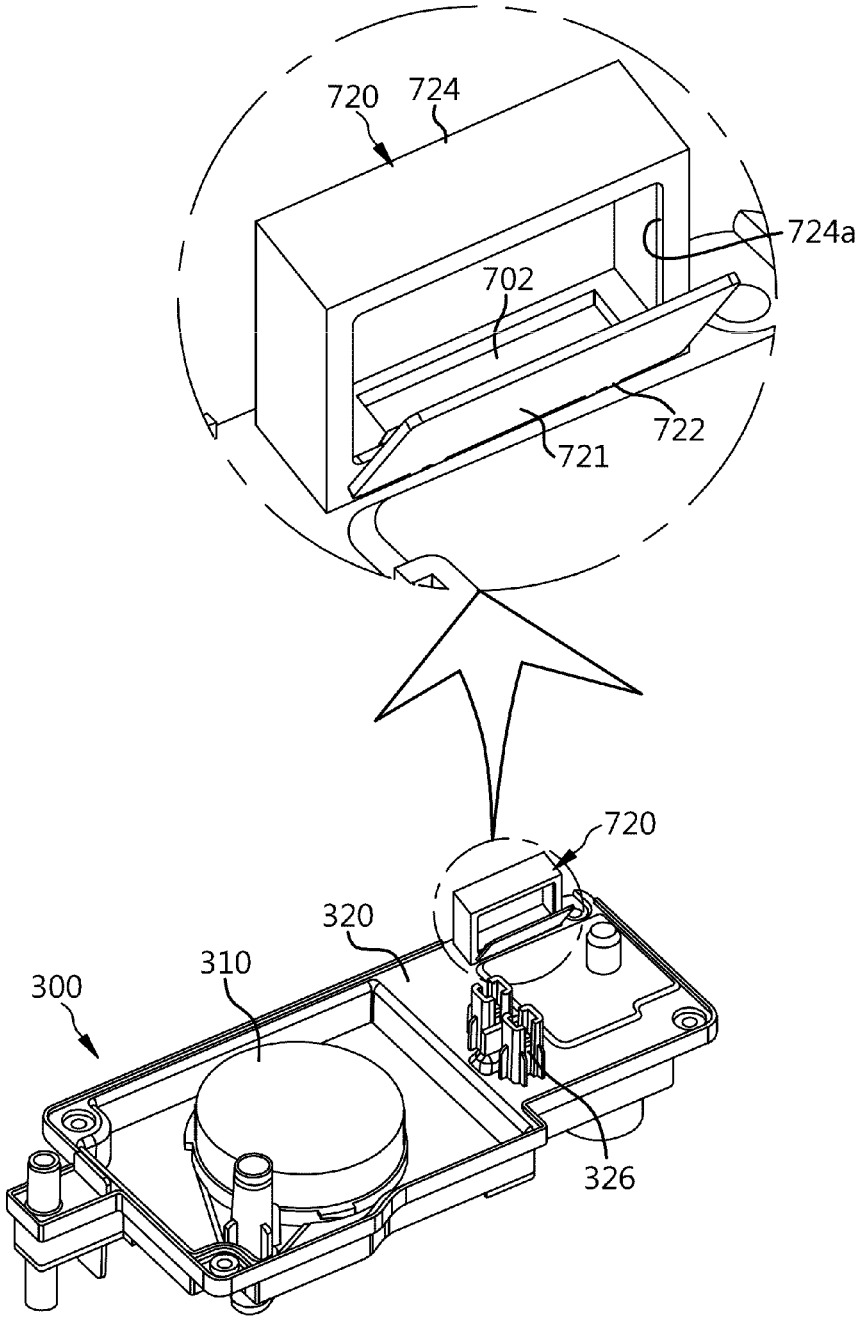
FIG. 20 is a perspective view of a drainage pump assembly, the perspective view showing an installation state in which the second opening and closing unit of the laundry processing apparatus according to the embodiment of the present disclosure is installed in the drainage pump assembly.

Further, the second swing door 720 is operated to close the second opening hole 702 when the drying operation or the drainage operation is performed (referring to FIG. 19). When the drying operation or the drainage operation is finished, the second swing door 720 is operated to open the second opening hole 702 (referring to FIGS. 18 and 20).

That is, considering that the inside space of the condensed water collecting part 151 and the inside space of the circulation flow path 800 communicate with each other through the passing hole 802, when the inside space of the circulation flow path 800 is under the state of negative pressure due to performance of the drying operation, the inside space of the condensed water collecting part 151 is also under the state of negative pressure.

Accordingly, the contact plate 721 of the second swing door 720 is brought into close contact with the wall surface of the closed tube 724 by the air suction force acting in the closed tube 724 so that the auxiliary hole 724*a* is closed.

The problem in which pressure in the condensed water collecting part 151 leaks is prevented by closing the auxiliary hole 724*a*.

When the inside of the circulation flow path 800 is under a state of atmospheric pressure after the drying operation is finished, the inside of the condensed water collecting part 151 is also under the state of atmospheric pressure.

In this case, the contact plate 721 of the second swing door 720 is tilted away from the wall of the closed tube 724 by the its own weight, so that the auxiliary hole 724*a* is opened.

The condensed water collecting space of the condensed water collecting part 151 communicates with the inside space of the cabinet 100 and is quickly dried by the air in the cabinet 100.

When the drainage operation is performed, the inside space of the condensed water collecting part 151 is under the state of negative pressure (vacuum pressure) by pumping operation of the drainage pump 310.

Therefore, during the drainage operation, the contact plate 721 of the second swing door 720 is brought into close contact with the wall of the closed tube 724 by the air suction force acting in the closed tube 724, so that the auxiliary hole 724*a* is closed.

Accordingly, the problem in which the pressure in the condensed water collecting part 151 leaks is prevented.

When the drainage operation is finished, the negative pressure acting in the condensed water to collecting part 151 is eliminated.

Therefore, the contact plate 721 of the second swing door 720 is tilted away from the wall of the closed tube 724 to open the auxiliary hole 724*a*. Accordingly, the condensed water collecting space in the condensed water collecting part 151 is quickly removed by the air in the cabinet 100 while communicating with the inside space of the cabinet 100.

Meanwhile, the opening and closing unit applied to the drainage pump assembly 300 is not limited to be embodied only in the structure of the second swing door 720 described above.

That is, a structure (opening and closing unit) to communicate with the inside space of the condensed water collecting part 151 with the drainage pump assembly 300 and to selectively open and close the communication portion by the pressure in the condensed water collecting part 151 may be provided variously.

Figure 21:
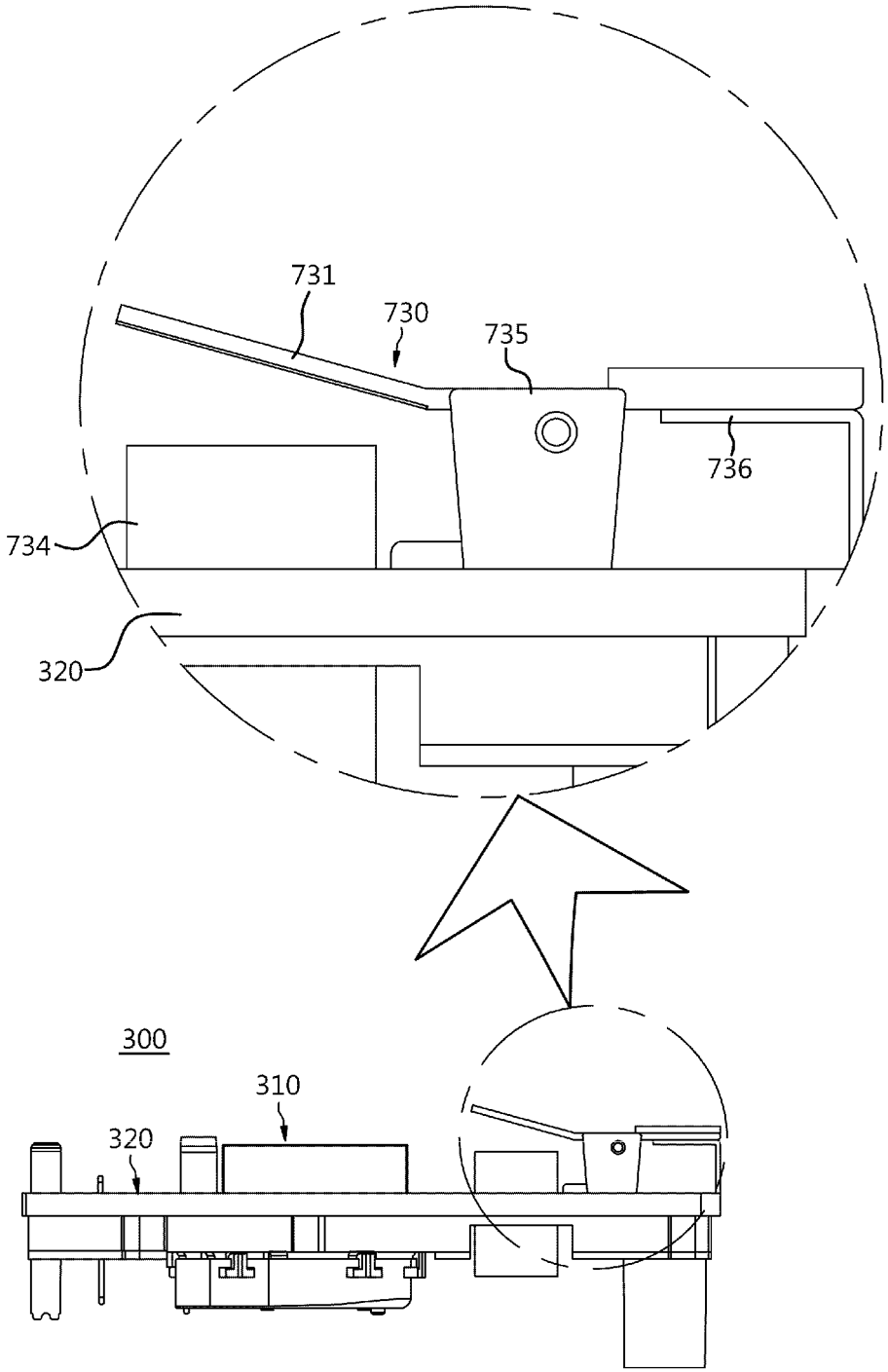
FIG. 21 is a front view of the drainage pump assembly, the front view showing the installation state in which the second opening and closing unit of the laundry processing apparatus according to the embodiment of the present disclosure is installed in the drainage pump assembly.
Figure 22:
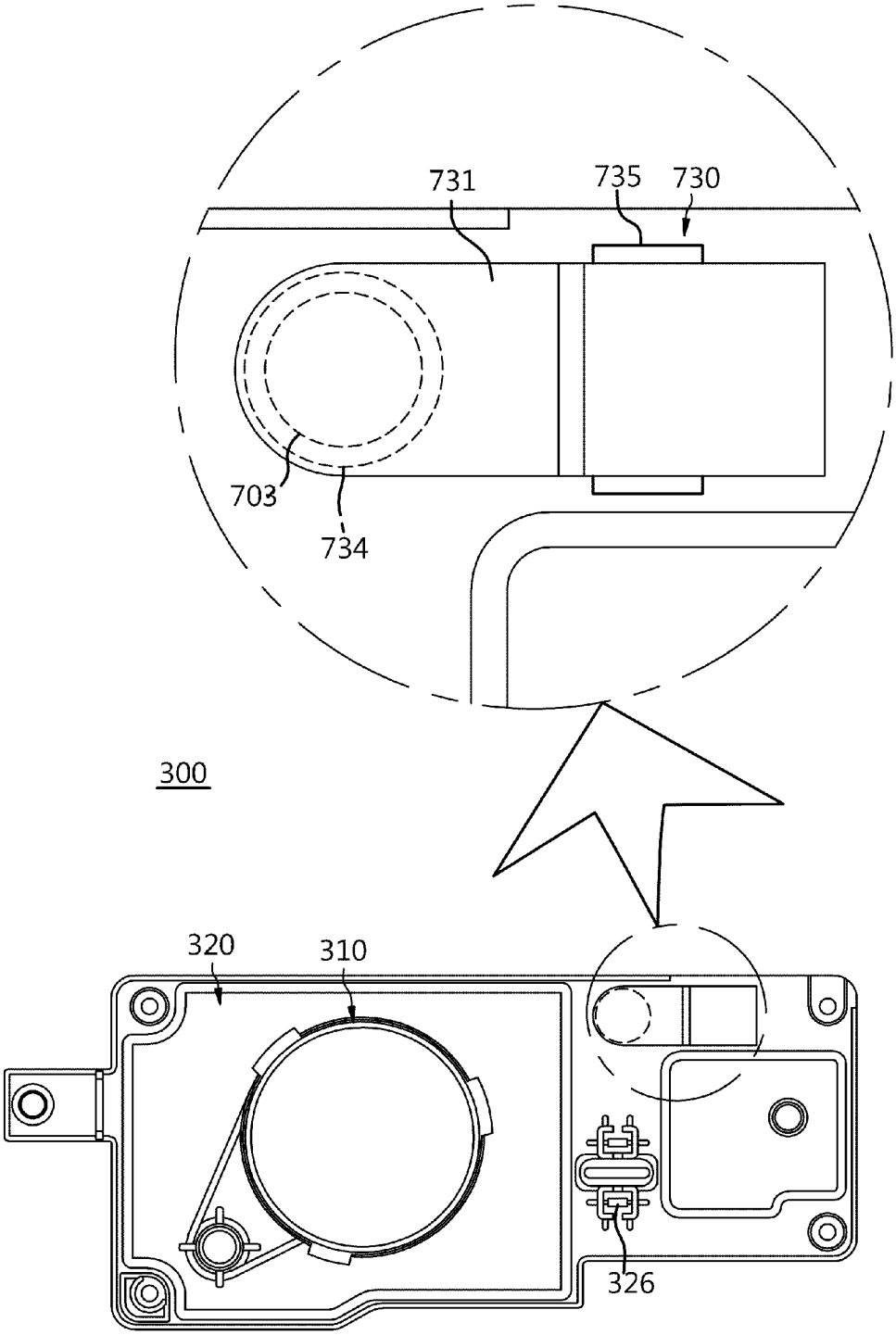
FIG. 22 is a plan view of the drainage pump assembly, the plan view showing an installation state in which a third opening and closing unit of the laundry processing apparatus according to the embodiment of the present disclosure is installed in the drainage pump assembly.
Figure 23:
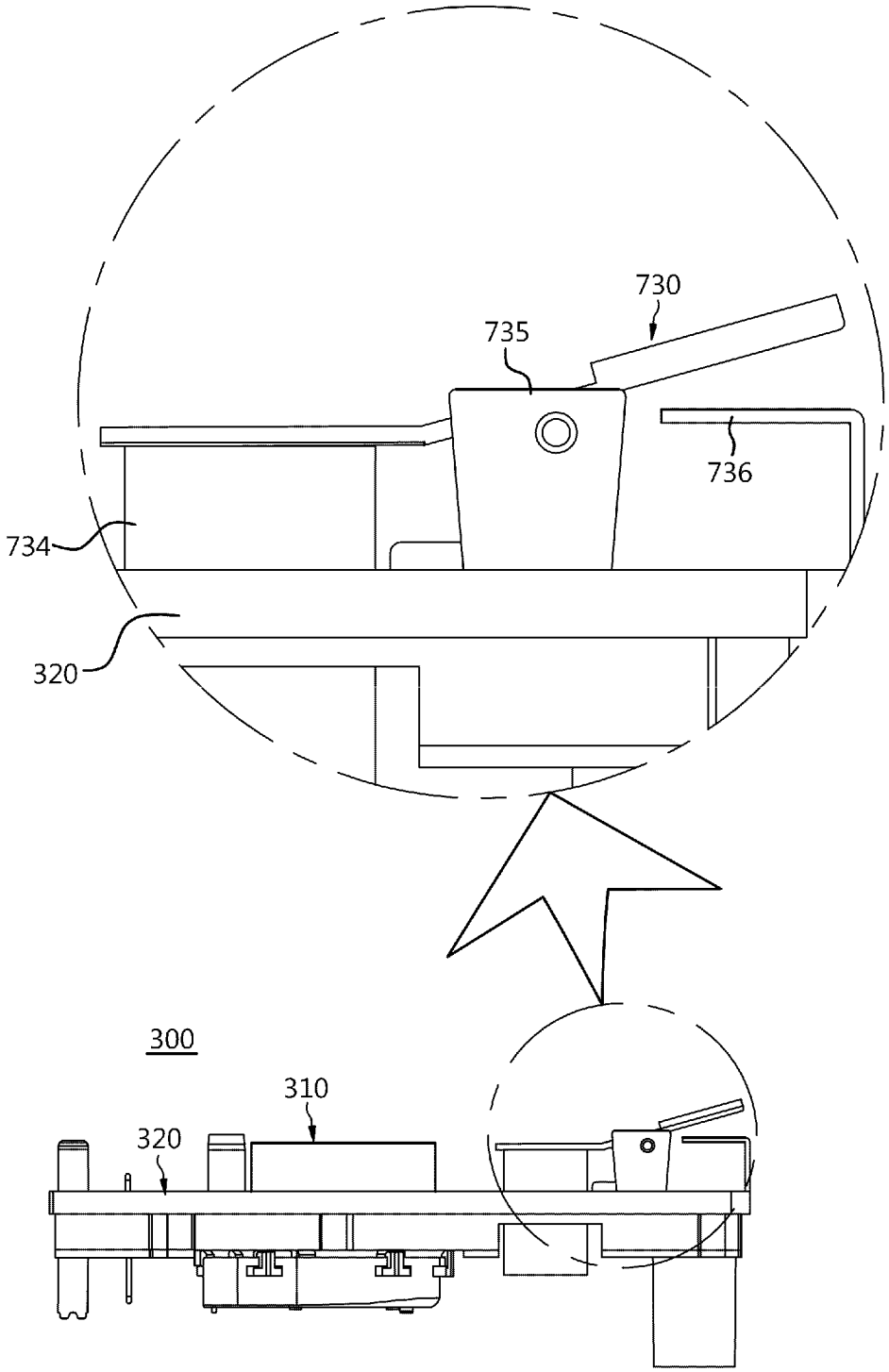
FIG. 23 is a front view of the drainage pump assembly, the front view showing the installation state in which the third opening and closing unit of the laundry processing apparatus according to the embodiment of the present disclosure is installed in the drainage pump assembly.

For example, a third swing door 730 having a form as shown in FIGS. 21 to 23 may be applied to the drainage pump assembly 300.

The third swing door 730 may include a closed tube 734 and a contact plate 731.

The closed tube 734 is configured as a tubular body that is vertically open structure (open lower and upper surfaces) and the open lower surface covers a third opening hole 703 formed on the pump cover 320.

The contact plate 731 may be provided to cover the open upper surface of the closed tube 734.

In addition, an installation bracket 735 is provided on an upper surface of the pump cover 320 of the drainage pump assembly 300, and the contact plate 731 may be rotatably mounted to the installation bracket 735.

Front and rear ends of the contact plate 731 are provided to be respectively exposed to the front and rear of the installation bracket 735. A front end lower surface of the contact plate 731 may be configured to cover the open upper surface of the closed tube 734.

In particular, based on a rotation center of the contact plate 731, a portion positioned at the upper side of the closed tube 734 may be configured to be lighter than a portion opposite thereto. Here, the rotation center of the contact plate 731 may be formed by a hinge shaft, as shown in FIGS. 21 and 23.

Accordingly, when external force is not applied to the contact plate 731, the portion positioned at the upper side of the closed tube 734 is moved downward by its own weight to cover and close the open upper surface of the closed tube 734.

Further, a limitation step 736 may be provided on the upper surface of the drainage pump assembly 300, the limitation step 736 limiting a downward rotation distance of the opposite portion of the contact plate 731.

Although not shown in the drawings, instead of the limitation step 736, rotation angle of the contact plate 731 may be limited.

Meanwhile, the first swing door 710 and the second swing door 720 (or third swing door) according to the above-described embodiment of the present disclosure may be simultaneously applied or separately applied to the laundry processing apparatus.

That is, only the first swing door 710 may be applied to the laundry processing apparatus according to the embodiment of the present disclosure, both of the first swing door 710 and the second swing door 720 may be applied thereto, and only the second swing door 720 may be applied thereto.

As described above, the laundry processing apparatus of the present disclosure is configured such that, the condensed water collecting space that stores the condensed water and is partitioned from the inside space of the cabinet 100 may be opened to the inside space of the cabinet 100, thus the condensed water remaining in the condensed water collecting space may be quickly removed by outside air.

Further, the laundry processing apparatus of the present disclosure is configured such that, the opening hole 701, 702 is closed during the drying operation or the drainage operation, thus pressure loss during each operation may be prevented.

Further, the laundry processing apparatus of the present disclosure is configured as a non-electronic structure in which the swing door 710, 720 provided to selectively open and close the opening hole 701, 702 is operated by using the pressure in the condensed water collecting space, thus the swing door may be accurately operated at the correct timing without the need for separate control.

Further, the laundry processing apparatus of the present disclosure is configured such that, the opening hole 701, 702 and the swing door 710, 720 selectively open the inside space of the circulation flow path 800, thus the condensed water remaining in the bottom of the circulation flow path 800 may be quickly removed.

Further, the laundry processing apparatus of the present disclosure is configured such that, the opening hole 701, 702 and the swing door 710, 720 selectively open the inside space of the condensed water collecting part 151, thus the condensed water remaining in the condensed water collecting part 151 may be quickly removed.

Further, the laundry processing apparatus of the present disclosure is configured as the non-electronic structure in which the swing door 710, 720 constituting the laundry processing apparatus opens the opening hole 701, 702 while being operated by its own weight when the pressure in the condensed water collecting space is eliminated, thus the swing door may be accurately operated at the correct timing without the need for separate control.

What is claimed is:

1. A laundry processing apparatus comprising:

a cabinet;

a drum disposed in the cabinet;

a wall that is disposed inside the cabinet and defines a circulation flow path in the cabinet, the circulation flow path being configured to guide air discharged from the drum;

an evaporator and a condenser that are disposed in the circulation flow path to allow the air to pass through the evaporator and the condenser; and a condensed water collecting part configured to receive and collect condensed water carried along a bottom of the circulation flow path, the condensed water collecting part comprising a drainage pump assembly, wherein the wall further defines:

a condensed water collecting space configured to guide and collect the condensed water, and an opening hole configured to communicate with an inside of the cabinet, and wherein the laundry processing apparatus further comprises an opening and closing member configured to open and close the opening hole defined at the wall.

2. The laundry processing apparatus of claim 1, wherein the opening and closing member is configured to close the opening hole based on air pressure inside the condensed water collecting space.

3. The laundry processing apparatus of claim 1, wherein the opening and closing member is configured to be spaced apart from the opening hole to open the opening hole based on a weight of the opening and closing member.

4. The laundry processing apparatus of claim 1, wherein the opening hole is defined at an outer surface of the wall, and the opening and closing member is disposed at the outer surface of the wall, and wherein an inside of the condensed water collecting space has a negative air pressure based on the air passing through the evaporator and the condenser.

5. The laundry processing apparatus of claim 1, wherein the opening hole is defined at an inner surface of the wall, and the opening and closing member is disposed at the inner surface of the wall, and wherein an inside of the condensed water collecting space has a positive air pressure based on the air passing through the evaporator and the condenser.

6. The laundry processing apparatus of claim 1, wherein the opening and closing member comprises a contact plate configured to open and close the opening hole.

7. The laundry processing apparatus of claim 6, wherein the opening and closing member further comprises a penetrating installation part that protrudes from a circumference of the contact plate toward the wall, the penetrating installation part passing through the wall.

8. The laundry processing apparatus of claim 7, wherein the wall defines an installation slot, and wherein the penetrating installation part comprises:

a penetrating end that passes through the installation slot, a width of the penetrating end being less than a width of the installation slot; and a locking end that is extended or bent from the penetrating end, the locking end being exposed to an outside of the installation slot.

9. The laundry processing apparatus of claim 8, wherein the installation slot is defined at a lower side of the opening hole on the wall, and wherein the penetrating installation part protrudes from a lower circumference of the contact plate.

10. The laundry processing apparatus of claim 9, wherein a weight of an upper side portion of the contact plate is greater than a weight of a lower side portion of the contact plate.

11. The laundry processing apparatus of claim 10, wherein at least a part of the upper side portion of the contact plate is thicker than the lower side portion of the contact plate.

12. The laundry processing apparatus of claim 1, wherein the wall defines the circulation flow path.

13. The laundry processing apparatus of claim 12, wherein the opening hole is defined at a position corresponding to the evaporator in the circulation flow path.

14. The laundry processing apparatus of claim 1, wherein the drainage pump assembly includes an upper surface corresponding to the wall that defines the opening hole.

15. The laundry processing apparatus of claim 14, wherein the opening and closing member comprises:

a closed tube disposed on the upper surface of the drainage pump assembly, the closed tube having:

an open lower surface that faces the opening hole defined at the upper surface of the drainage pump assembly, a closed upper surface disposed vertically above the open lower surface, and a lateral surface that defines an auxiliary hole;

a contact plate disposed at an outside of the lateral surface of the closed tube and configured to open and close the auxiliary hole; and a penetrating installation part that protrudes from a circumference of the contact plate toward the lateral surface of the closed tube, the penetrating installation part passing through the lateral surface of the closed tube.

16. The laundry processing apparatus of claim 14, wherein the opening and closing member comprises:

a closed tube disposed on at the upper surface of the drainage pump assembly, the closed tube having:

an open lower surface that faces the opening hole defined at the upper surface of the drainage pump assembly, and an open upper surface disposed vertically above the open lower surface; and a contact plate configured to open and close the open upper surface of the closed tube.

17. The laundry processing apparatus of claim 16, wherein the opening and closing member further comprises an installation bracket that is disposed at the upper surface of the drainage pump assembly, and wherein the contact plate is rotatably connected to the installation bracket.

18. The laundry processing apparatus of claim 17, wherein the contact plate comprises:

a front end portion that extends forward relative to a front of the installation bracket, that is disposed vertically above the open upper surface of the closed tube, and that is configured to open and close the open upper surface of the closed tube; and a rear end portion that extends rearward relative to a rear of the installation bracket.

19. The laundry processing apparatus of claim 18, wherein the opening and closing member further comprises a hinge shaft, wherein the contact plate comprises:

a first portion disposed at a first side with respect to the hinge shaft, the first portion being disposed above the open upper surface of the closed tube and including the front end portion of the contact plate, and a second portion disposed at a second side with respect to the hinge shaft, and wherein a weight of the first portion of the contact plate is less than a weight of the second portion of the contact plate.

20. The laundry processing apparatus of claim 19, wherein the drainage pump assembly comprises a step disposed at the upper surface of the drainage pump assembly and configured to contact the second portion of the contact plate to thereby limit rotation of the contact plate.

* * * * *